United States Patent [19]

Yamanaka et al.

[11] Patent Number: 4,734,738

[45] Date of Patent: Mar. 29, 1988

[54] COPYING APPARATUS

[75] Inventors: Toshio Yamanaka, Yao; Yasuji Sumida, Kita Katsuragi, both of Japan

[73] Assignee: Mita Industrial Co., Ltd., Osaka, Japan

[21] Appl. No.: 854,838

[22] Filed: Apr. 23, 1986

[30] Foreign Application Priority Data

Apr. 28, 1985 [JP] Japan ..... 60-91711
Apr. 29, 1985 [JP] Japan ..... 60-92000
Apr. 30, 1985 [JP] Japan ..... 60-94082

[51] Int. Cl.[4] ..... G03G 21/00

[52] U.S. Cl. ..... 355/14 SH; 271/9; 271/121; 355/24

[58] Field of Search ..... 355/3 R, 3 SH, 14 SH, 355/24; 271/121, 171, 9

[56] References Cited

U.S. PATENT DOCUMENTS 3,406,964 10/1968 Eichorn ..... 271/171
3,615,129 10/1971 Drawe et al. ..... 355/25
4,032,136 6/1977 Komaba et al. ..... 271/171 X
4,218,128 8/1980 Satomi et al. ..... 355/14 SH
4,343,461 8/1982 Tomimori et al. ..... 271/171 X
4,368,880 1/1983 Shimizu ..... 271/121
4,397,541 8/1983 Lopata et al. ..... 355/14 SH
4,453,819 6/1984 Wada et al. ..... 355/3 SH
4,457,507 7/1984 Ishikawa et al. ..... 271/171 X
4,509,738 4/1985 Aoki ..... 271/171 X
4,523,754 6/1985 Hisajima et al. ..... 355/3 SH X
4,523,832 6/1985 Strutt et al. ..... 355/3 SH
4,561,772 12/1985 Smith ..... 355/14 SH
4,585,336 4/1986 Tanaka ..... 355/3 SH

*Primary Examiner*—Fred L. Braun
*Attorney, Agent, or Firm*—Wenderoth, Lind & Ponack

[57] ABSTRACT

A copying apparatus capable of producing a copied image on both surfaces of a copying paper as required includes a copying paper receiving and delivering device capable of receiving a copying paper returned through a copying paper returning passage and delivering it to a copying paper conveying passage. The paper receiving and delivering device includes a copying paper receiving stand supporting member disposed within a housing of the apparatus and a copying paper receiving stand to be mounted detachably on the supporting member, and the paper returned through the paper returning passage is received on the paper receiving stand. Alternatively, the paper receiving and delivering member includes a copying paper receiving stand detachably mounted on the housing and at least partly projecting out of the housing, and the paper returned through the paper returning passage is received on the paper receiving stand. Furthermore, copying paper sheets can be loaded manually on the paper receiving stand from outside the housing.

30 Claims, 13 Drawing Figures

COPYING APPARATUS

BACKGROUND OF THE INVENTION

1. Field of the Invention

This invention relates to a copying apparatus, and more specifically, to a copying apparatus capable of forming an image on both surfaces of a copying paper as required.

2. Description of the Prior Art

It is often desired to form an image on both surfaces of a copying paper in order to save copying paper sheets and reduce the number of documents to be preserved, and copying apparatus capable of forming an image on both surfaces of a copying paper as required have recently been proposed and come into commercial acceptance.

A typical example of such a copying apparatus comprises a housing, a photosensitive member disposed within the housing, an image-forming means for forming an image on the photosensitive member, a copying paper conveying passage defined within the housing and extending through a transfer zone in which the image on the photosensitive member is transferred to a copying paper, a copying paper feed means for feeding a copying paper to the upstream end of the paper conveying passage, a copying paper returning passage defined with the housing, a conveyance control means disposed within the housing, and a copying paper receiving and delivering means disposed within the housing. The conveyance control means is adapted to be selectively held at a first position for discharging the copying paper conveyed through the paper conveying passage and a second position for conducting the copying paper conveyed through the paper conveying passage to the paper returning passage. The copying paper receiving and delivering means receives the copying paper returned through the paper returning passage, and delivers the received paper to the upstream end of the paper conveying passage.

In this copying apparatus, an image is formed on one surface of the copying paper while it is conveyed through the paper conveying passage after being fed from the paper feed means. When it is desired to form an image only on one surface, the copying paper having the image formed on one surface is discharged outside the housing. On the other hand, when it is desired to form an image on both surfaces of the copying paper, the copying paper having the image formed on one surface is then introduced into the paper returning passage and returned to the paper receiving and delivering means through the paper returning passage. It is delivered again to the paper conveying passage from the paper receiving and delivering means, and while being reconveyed through the paper conveying passage, an image is formed on the other surface of the paper. The paper having the image formed on both surfaces is then discharged out of the housing.

The conventional apparatus, however, has the following problems to be solved.

Firstly, in the event of paper jamming in the paper receiving and delivering means disposed within the housing, the jamming paper must be removed by performing such an operation as opening of various portions of the housing. It is not sufficiently easy and rapid therefore to remove the jamming paper and resume the copying operation.

Secondly, it is generally far less frequent to require image formation on both surfaces of a copying paper than to require it on one surface. Most of the time during which the copying apparatus is in motion, an image is formed only on one surface of a copying paper. In this one surface copying mode, the paper receiving and delivering means does not function at all. For an increased efficiency of copying, it is desired to feed copying paper sheets of various sizes selectively to the paper conveying passage. This, however, necessitates an increased number of paper feed means, and will result in an increase in the size of the copying apparatus and the cost of producing it.

Thirdly, the conveyance control means, the paper returning passage and the paper receiving and delivering means which enable an image to be formed on both surfaces of a copying paper are relatively complex in structure, and the cost of production is relatively high.

SUMMARY OF THE INVENTION

It is a primary object of this invention to provide a novel and improved copying apparatus in which in the event of paper jamming in the paper receiving and delivering means, the jamming paper sheet can be removed, and the copying operation can be resumed, sufficiently easily and rapidly.

Another object of this invention is to provide a novel and improved copying apparatus in which when an image is to be formed only on one surface of a copying paper, the paper receiving and delivering means provided for image formation on both surfaces of the copying paper can be effectively utilized to deliver a new copying paper having no image formed on either surface to the upstream end of the paper conveying passage, and therefore, the efficiency of copying during image formation on one surface of the copying paper can be increased without the need to increase the number of paper feed means.

Still another object of this invention is to provide a novel and improved copying apparatus in which the conveyance control means, the paper returning passage and the paper receiving and delivering means for image formation on both surfaces of the copying paper sheet are simplified in structure and the cost of production is curtailed.

In a copying apparatus constructed in accordance with one aspect of the invention, the copying paper receiving and delivering means includes a copying paper receiving stand supporting means formed within the housing and a copying paper receiving stand detachably mounted on the supporting means, and a copying paper returned through a copying paper returning passage is received by the paper receiving stand. Preferably, the paper receiving and delivering means is constructed such that a plurality of copying paper sheets can be manually loaded on the paper receiving stand detached from the supporting means and then the paper receiving stand can be mounted on the paper receiving stand supporting means whereby the paper sheets loaded manually on the receiving stand are delivered one by one toward the upstream end of the paper conveying passage. Alternatively, the paper receiving and delivering means is constructed such that a paper cassette holding a plurality of copying paper sheets instead of the paper receiving stand can be detachably mounted on the paper receiving stand supporting means whereby the copying paper sheets held in the paper cassette can be delivered one by one toward the upstream end of the copying paper conveying passage.

In a copying apparatus constructed in accordance with another aspect of this invention, the copying paper receiving and delivering means includes a copying paper receiving stand mounted detachably on the housing and at least partly projecting out of the housing. A copying paper returned through the paper returning passage is received by the paper receiving stand, and copying paper sheets can be manually loaded on the paper receiving stand from outside the housing.

In a copying apparatus constructed in accordance with still another aspect of the invention, a unique improvement has been made on at least one of the conveyance control means, the copying paper returning passage, and the paper receiving and delivering means.

Further objects of this invention along with its advantages will become apparent from the following detailed description taken in conjunction with the accompanying drawings.

DETAILED DESCRIPTION OF PREFERRED EMBODIMENTS

With reference to the accompanying drawings, specific embodiments of the copying apparatus constructed in accordance with this invention will be described in detail.

Outline of First Embodiment

Figure 1:
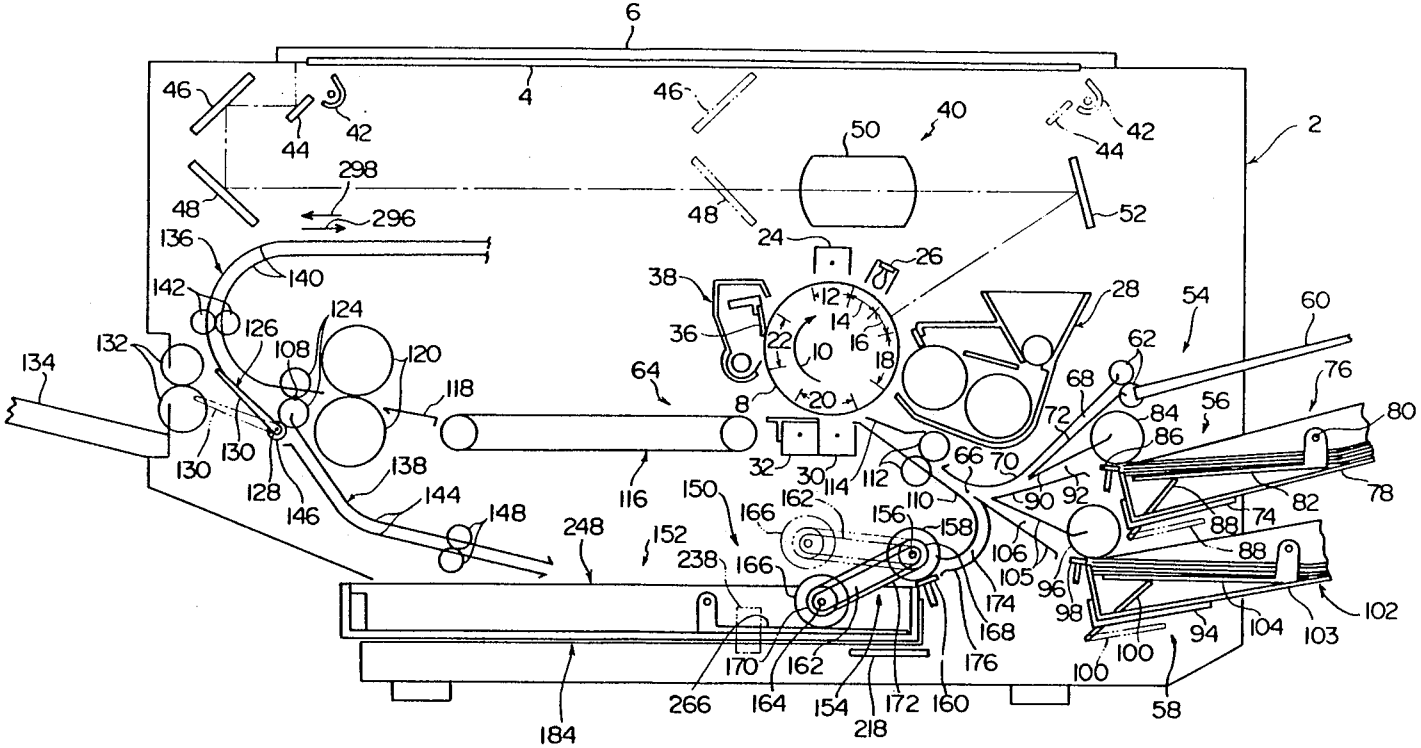
FIG. 1 is a simplified sectional view showing a first embodiment of the copying apparatus constructed in accordance with this invention.

FIG. 1 illustrates in a simplified form the main constituent elements of one specific embodiment of the copying apparatus constructed in accordance with this invention. The copying apparatus shown in FIG. 1 has a nearly parallelepipedal housing 2. On the upper surface of the housing 2 are disposed a stationary transparent plate 4 on which to place a document (not shown) to be copied and an openable-closable document holding member 6 for covering the transparent plate 4 and the document placed thereon.

A rotating drum 8 having a photosensitive member on its peripheral surface is mounted rotatably at nearly the central portion of the housing 2. Around the rotating drum to be rotated in the direction of an arrow 10 are defined a charging zone 12, a preliminary charge eliminating zone 14, an exposing zone 16, a developing zone 18, a transfer zone 20 and a cleaning zone 22 in this order as viewed in the direction of arrow 10. A charge eliminating lamp 26 is disposed in the preliminary charge eliminating zone 14, and a developing device 28 is disposed in the developing zone 18. In the transfer zone 20 are provided a transfer corona discharge device 30 and a peeling corona discharge device 32. A cleaning device 38 including a blade 36 for removing residual toner is disposed in the cleaning zone 22.

An optical system shown generally at 40 is provided above the rotating drum 8. The optical system 40 comprises a movable document-illuminating lamp 42, a first movable reflecting mirror 44, a second movable reflecting mirror 46, a third movable reflecting mirror 48, a stationary lens assembly 50 and a stationary reflecting mirror 52. During a scanning-exposure operation, the movable document illuminating lamp 42 and the first movable reflecting mirror 44 are moved at a predetermined velocity V to a predetermined position (for example, a maximum end-of-scan position shown by the two-dot chain lines) substantially horizontally from a start-of-scan position shown by the solid lines, and the second movable reflecting mirror 46 and the third movable reflecting mirror 48 are moved at a velocity half of the aforesaid velocity V (V/2) to a predetermined position (for example, a maximum end-of-scan position shown by the two-dot chain lines) substantially horizontally from a start-of-scan position shown by the solid lines. At this time, the document placed on the transparent plate 4 is illuminated by the movable document illuminating lamp 42, and the light reflected from the document is successively reflected by the first, second and third movable reflecting mirrors 44, 46 and 48 and reaches the lens assembly 50, from which it is reflected by the stationary reflecting mirror 52 and projected onto the photosensitive member in the exposing zone 16. When the scanning-exposure operation is over, the movable document illuminating lamp 42 and the first, second and third reflecting mirrors 44, 46 and 48 are returned to the start-of-scan position shown by the solid lines.

In one end portion (the right end portion in FIG. 1) of the housing 2 are disposed a first copying paper feed means 54, a second copying paper feed means 56 and a third copying paper feed means 58 in this order from top to bottom. The first paper feed means 54 is of a known manually operating type, and its rear half portion includes a manual feed stand 60 extending out of the housing 2. A paper feed roller pair 62 is provided immediately ahead of the manual feed stand 60. A copying paper feed passage 68 extends up to the upstream end 66 of a copying paper conveying passage 64 (the paper conveying passage 64 will be described further hereinafter). The paper feed passage 68 is defined by the upstream portion of a guide plate 70 and a guide plate 72. When the operator advances a copying paper along the upper surface of the manual feed stand 60 in the first paper feed means 54, the paper is fed by the paper feed roll pair 62 to the paper conveying passage 64 through the paper feed passage 68. The second paper feed means 56 is of a known automatic operating type, and includes a paper cassette supporting means 74. A paper cassette 76 is detachably mounted on the supporting means 74 through an opening formed in the right end wall of the housing 2. The illustrated paper cassette 76 has a box-like frame member 78 whose front end portion is adapted to be positioned on the supporting means 74. A receiving plate 82 is pivotably mounted by a short shaft 80 in the front half of the frame member 78. The front half portion of a plurality of stacked copying paper sheets received in the paper cassette 76 is placed on the receiving plate 82. Above the supporting means 74 are provided a paper feed roller 84 to be selectively rotated and a friction pad 86 pressed by the paper feed roller 84. Furthermore, a receiving plate elevating member 88 is provided in relation to the supporting means 74. The receiving plate elevating member 88 is held at an inoperative position shown by the two-dot chain lines by a suitable locking mechanism (not shown) during the mounting and detaching operations of the paper cassette 76. But when the action of the locking mechanism is cancelled, the elevating member 88 is pivoted counterclockwise through an opening (not shown) formed in the frame member 78 of the paper cassette 76 and the supporting member 74 as shown by the solid lines and acts on the receiving plate 82 to pivot it elastically clockwise about the short shaft 80 as a center. As a result, the elevating member 88 elevates the receiving plate 82 and the leading end portion of the stack of paper sheets on it and presses the uppermost paper sheet against the paper feed roller 84. A copying paper feed passage 92 defined by a guide plate pair 90 extends from the paper feed roller 84 to the upstream end of the paper conveying passage 64. In the second paper feed means 56, the copying paper sheets are fed one by one from the paper cassette 76 to the paper conveying passage 64 through the paper feed passage 92 by the rotation of the paper feed roller 84. The friction pad 86 which is formed of a material having a high coefficient of friction prevents the feeding of two or more copying paper sheets at a time. The third paper feed means 58 is of the same automatic operating type as the second paper feed means 56, and includes a paper cassette supporting means 94, a paper feed roller 96, a friction pad 98 and a receiving plate elevating member 100. A paper cassette 102 is detachably mounted on the supporting means 94 through an opening formed in the right end wall of the housing 2. The paper cassette 102 having a box-like frame member 103 and a receiving plate 104 may be of the same construction as the paper cassette 76 described above. The paper cassettes 102 and 76 may hold copying paper sheets of different sizes. A copying paper feed passage 106 defined by a guide plate pair 105 extends from the paper feed roller 96 to the upstream end of the paper conveying passage 64. In the third paper feed means 58, copying paper sheets are fed one by one from the paper cassette 102 to the paper conveying passage 64 through the paper feed passage 106 by the rotation of the paper feed roller 96. The friction pad 98, which is formed of a material having a high coefficient of friction, prevents the feeding of two or more paper sheets at a time.

The paper conveying passage 64 extends nearly horizontally from right to left in FIG. 1 from the upstream end 66 to the downstream end 108 through the transfer zone 20. The paper conveying passage 64 is defined by the downstream portion of the guide plate 70, the downstream portion of a guide plate 110, a conveying roller pair 112, a guide plate 114, the transfer zone 20 (i.e., the space between the rotating drum 8 and the transfer corona discharge device 30 and the peeling corona discharge device 32), a conveyor belt mechanism 116, a guide plate 118, a heat-fixing roller pair 120, and a conveyor roller pair 124.

A conveyance control means 126 is disposed adjacent to the downstream end 108 of the paper conveying passage 64. The conveyance control means 126 is comprised of a plurality of control members 130 (only one of which is shown in FIG. 1) fixed to a shaft 128 extending in the widthwise direction (the direction perpendicular to the sheet surface in FIG. 1) in spaced-apart relationship in the widthwise direction. A suitable positioning means (not shown) such as an electromagnetic solenoid is linked to the shaft 128. When the positioning means is in the deenergized state, the shaft 128 and the control members 130 fixed to it are held at a first position shown by the two-dot chain lines. Energization of the positioning means causes the shaft 128 and the control members 130 fixed to it to rotate clockwise through a predetermined angle and be held at a second position shown by the solid lines. A discharge roller pair 132 is provided on the downstream side of the conveyance control means 126, i.e. in the left end of the housing 2. A discharge opening is formed in the left end wall of the housing 2, and a receiving tray 134 is detachably mounted on the left end wall of the housing 2.

Further, in relation to the conveyance control means 126, there are provided a copying paper reversing passage shown generally at 136 and a copying paper returning passage shown generally at 138. The paper reversing passage 136 is defined by a guide plate pair 140, and extends in a suitable curved shape from its upstream end adjacent to the conveyance control means 126. A reversing roller pair 142 is disposed in the paper reversing passage 136. The paper returning passage 138 is defined by a guide plate pair 144 and extends from the upstream end of the conveyance control means 126 in a slightly curved fashion from left to right in FIG. 1. A follower roller 146 is also rotatably mounted on the shaft 128 to which the conveyance control members 130 are fixed. The follower roller 146, in cooperation with the lower roller of the conveyor roller pair 124 defining the downstream end 108 of the paper conveying passage 64, defines the upstream end of the paper returning passage 138. A conveyor roller pair 148 is disposed in the paper returning passage 138.

In the illustrated copying apparatus a copying paper receiving and delivering means shown generally at 150 is provided below the paper returning passage 138. The paper receiving and delivering means 150 includes a copying paper receiving stand 152 and a copying paper delivery means 154 disposed in relation to the front end portion of the paper receiving stand 152. The paper delivery means 154 includes a paper feed roller 158 fixed to a rotating shaft 156 extending in the widthwise direction (the direction perpendicular to the sheet surface im FIG. 1). A friction pad 160 is provided in relation to the paper feed roller 158. The friction pad 160 formed of a material having a high coefficient of friction is pressed against the paper feed roller 158. One end portion of a supporting arm 162 is pivotably mounted on the rotating shaft 156. A rotating shaft 164 is rotatably mounted on the free end portion of the supporting arm 162, and a delivery roller 166 is fixed to the rotating shaft 164. A pulley 168 is fixed to the rotating shaft 156, and correspondingly, a pulley 170 is fixed to the rotating shaft 164. An endless belt 172 is wrapped about the pulleys 168 and 170. The rotating shaft 156 is selectively rotatable in the counterclockwise direction, and when the rotating shaft 156 is rotated, the paper feed roller 158 is rotated counterclockwise and the rotating shaft 164 and the delivery roller 166 fixed to it are also rotated counterclockwise via the pulley 168, belt 172 and pulley 170. A suitable elevating means (not shown) such as an electromagnetic solenoid is annexed to the supporting arm 162. When the elevating means is energized, the supporting arm 162 is pivoted clockwise to bring the delivery roller 166 to an inoperative position shown by a two-dot chain lines. Deenergization of the elevating means results in biasing the supporting arm 162 counterclockwise by its own weight and the weight of the delivery roller 166 mouned on its free end portion (or by a suitable spring means), and therefore, the delivery roller 166 is biased downwardly.

A copying paper feed passage 174 extends in an arcuate shape from the paper feed roller 158 to the upstream end 66 of the paper conveying passage 64. The paper feed passage 174 is defined by the upstream portion of the guide plate 110 and a guide plate 176.

The above-described construction of the illustrated copying apparatus does not constitute the novel improved features in accordance with this invention, but merely shows one example of the copying apparatus to which the invention is applied.

Copying paper receiving stand and its related parts in the first embodiment

In the copying apparatus constructed in accordance with this invention, it is important that the copying paper receiving stand 152 in the paper receiving and delivering means 150 should be detachably mounted at a required position.

Figure 2:
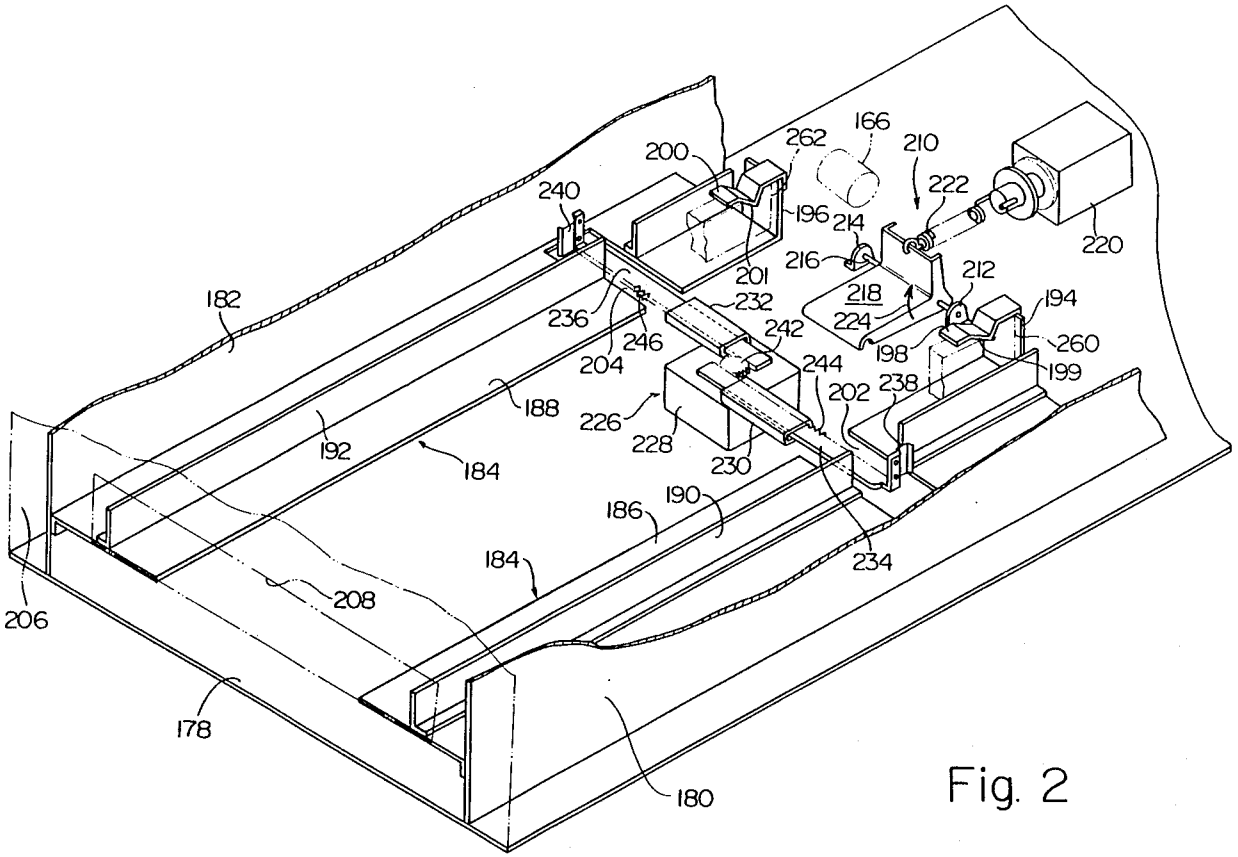
FIG. 2 is a partial perspective view showing a copying paper receiving stand supporting means in the copying apparatus of FIG. 1.

With reference to FIGS. 1 and 2, a front supporting base plate 180 and a rear supporting base plate 182 are provided within the housing 2 and are spaced from each other a predetermined distance in the widthwise direction (the direction perpendicular to the sheet surface in FIG. 1) and extend substantially vertically from a bottom wall 178. A copying paper receiving stand supporting means 184 is disposed in the lower portions of the inside surfaces of the supporting base plates 180 and 182. Horizontal plates 186 and 188 extending substantially horizontally over a predetermined length from the left end in FIG. 1 are fixed respectively to the inside surfaces of the supporting base plates 180 and 182. Upright plates 190 and 192 are fixed to the horizontal plates 186 and 188. Upright pieces 194 and 196 are formed on the front ends of the horizontal plates 186 and 188. Rearwardly projecting locking members 198 and 200 are fixed to the upper ends of the upright pieces 194 and 196. The locking members 198 and 200 which can be formed of spring steel have downwardly projecting nearly inverted triangular projecting portions 199 and 201 respectively. Cuts 202 and 204 for permitting movement of the actuating piece of a width adjusting member to be described are formed in the horizontal plates 186 and 188 and the front portions of the upright plates 190 and 192. A rectangular opening 208 for the paper receiving stand is formed in the lower portion of the left end wall 206 of the housing 2.

With reference to FIG. 2, a receiving plate elevating means shown generally at 210, which selectively acts on a movable receiving plate (to be described hereinafter) in the paper receiving stand 152, is disposed on the bottom wall 178 of the housing 2. In the illustrated embodiment, a pair of securing brackets 212 and 214 are fixed to the bottom wall 178 with a space therebetween in the widthwise direction, and a shaft 216 is fixed across the brackets 212 and 214. A nearly L-shaped receiving plate elevating member 218 is pivotably mounted on the shaft 216. The receiving plate elevating member 218 may be of substantially the same structure as the receiving plate elevating members 88 and 100 (FIG. 1) in the paper feed means 56 and 58. An electromagnetic solenoid 220 is mounted on the bottom plate 178, and its output terminal is linked to one end of the receiving plate elevating member 218 through a tension spring 222. When the electromagnetic solenoid 220 is in the deenergized state, the receiving plate elevating member 218 is held at the inoperative position shown in the drawing, but when the electromagnetic solenoid 220 is energized, the elevating member 218 is pulled via the tension spring 222 and pivoted in the direction shown by an arrow 224. A width adjusting means shown generally at 226 is also mounted on the bottom wall 178. The width adjusting means 226 includes a reversible electric motor 228 mounted on the bottom wall 178. Hollow square supporting members 230 and 232 extending in the widthwise direction are fixed to the upper surface of the casing of the motor 228. Width adjusting members 234 and 236 are mounted on the supporting members 230 and 232 movably in the widthwise direction. The projecting end portions of the width adjusting members 234 and 236 are bent upwardly, and actuating pieces 238 and 240 are attached to these projecting ends. A pinion gear 242 is fixed to the output shaft of the motor 228, and racks 244 and 246 adapted to engage the pinion gear 242 are formed on the corresponding side surfaces of the width adjusting members 234 and 236. When the pinion gear 242 is rotated clockwise as viewed from above, the width adjusting members 234 and 236 are synchronously moved inwardly in the widthwise direction. When the pinion gear 242 is rotated counterclockwise as viewed from above, the width adjusting members 234 and 236 are synchronously moved outwardly in the widthwise direction. During the widthwise movement of the width adjusting members 234 and 236, the actuating pieces 238 and 240 projecting upwardly beyond the horizontal plates 186 and 188 move through the cuts 202 and 204 formed in the horizontal plates 186 and 188 and the upright plates 190 and 192. In the state shown in the drawing in which the width adjusting members 234 and 236 have been moved most outwardly in the widthwise direction, the actuating pieces 238 and 240 are positioned slightly outwardly of the upright plates 190 and 192 in the widthwise direction.

Figure 3:
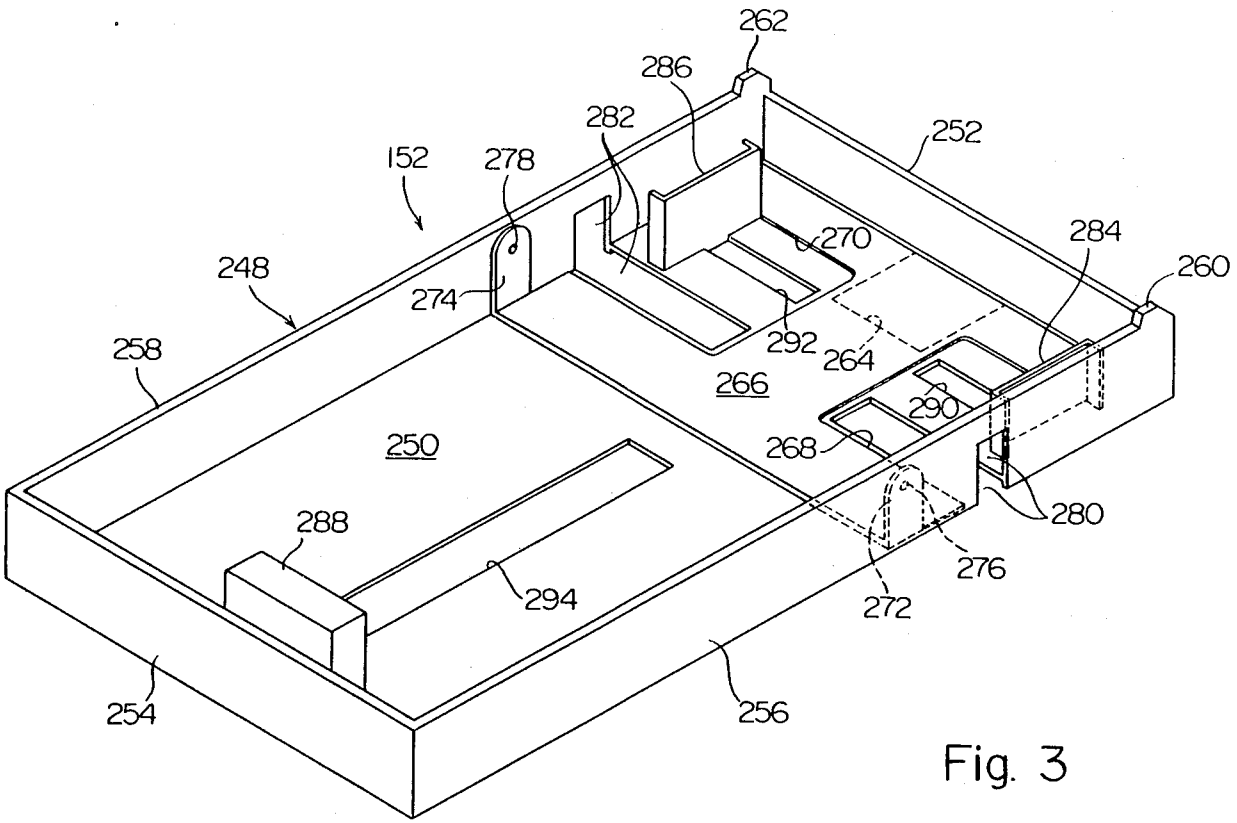
FIG. 3 is a perspective view showing a copying paper receiving stand in the copying apparatus of FIG. 1.
Figure 4:
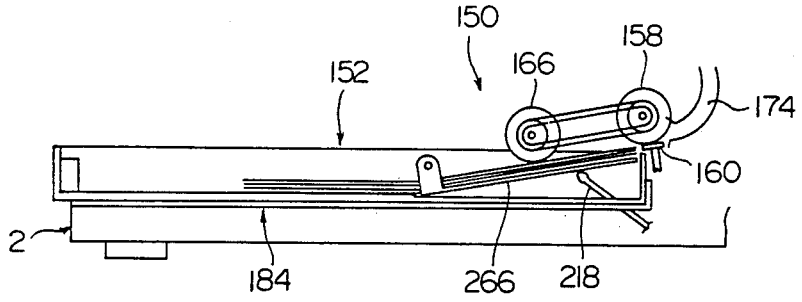
FIG. 4 is a simplified partial sectional view showing the state of the copying apparatus of FIG. 1 at the time of delivering a copying paper having an image formed on one surface thereof from the copying paper receiving stand.

FIG. 3 shows the paper receiving stand 152 to be mounted detachably on the paper receiving stand supporting means 184 through the opening 208 formed in the left end wall 206 of the housing 2. The illustrated paper receiving stand 152 includes a box-like frame member 248 with an open top. The frame member 248 has a bottom plate 250, a front wall 252, a rear wall 254 and side walls 256 and 258. The width of the frame member 248 corresponds to the distance between the upright plates 190 and 192 in the paper receiving stand supporting means 184, and the length of the frame member 248 corresponds nearly to the length of each of the horizontal plates 186 and 188 and the upright plates 190 and 192 in the paper receiving stand supporting means 184. Nearly trapezoidal locking protrusions 260 and 262 are formed respectively at the front ends of the upper edges of the side walls 256 and 258 of the frame member 248. As will be stated hereinbelow, the locking protrusions 260 and 262 cooperate with the locking members 198 and 200 in the paper receiving stand supporting means 184. An opening 264 adapted to permit passage of the free end portion of the receiving plate elevating member 218 is formed in the central part in the widthwise direction of the front end portion of the bottom wall 250. Conveniently, the size and shape of at least the front end portion of the frame member 248 are substantially the same as those of the frame members 78 and 103 of the paper cassettes 76 and 102 for use in the second and third paper feed means 56 and 58.

A receiving plate 266 is provided in the front end portion of the frame member 248 of the paper receiving stand 152. Comparatively large cuts 268 and 270 are formed on both sides of the intermediate portion, in the front-rear direction, of the receiving plate 266. The receiving plate is generally of an H-shape. Upright pieces 272 and 274 are formed on both side edges of the rear end portion of the receiving plate 266 and are pivotably mounted on the side walls 256 and 258 of the frame member 248 by means of pins 276 and 278. As will be stated hereinafter, when the receiving plate elevating member 218 (FIG. 2) is at its inoperative position, the receiving plate 266 is held at its paper receiving position shown in FIG. 3. When the electromagnetic solenoid 220 (FIG. 2) is energized and the receiving plate elevating member 218 is pivoted in the direction shown by arrow 224 (FIG. 2), the receiving plate 266 is pivoted about the pins 276 and 278 as a center by the action of the receiving plate elevating member 218. As a result, the front portion of the receiving plate 266 is elevated. In correspondence to the rear portions of the cuts 268 and 270 formed in the receiving plate 266, openings 280 and 282 in side walls 256 and 258 extending downwardly toward the bottom wall 250 and then in bottom wall 250 extending inwardly in the widthwise direction from the side walls 256 and 258 are formed on opposite side portions of the frame member 248. When the width adjusting members 234 and 236 (FIG. 2) move inwardly in the widthwise direction, their actuating pieces 238 and 240 advance into these openings 280 and 282.

A pair of width restricting members 284 and 286 and a rear edge restricting member 288 also are provided in the paper receiving stand 152 so that the paper receiving stand 152 can also be utilized as a so-called universal cassette (a paper cassette capable of selectively receiving copying paper sheets of various sizes). As shown in FIG. 3, in the regions of the cuts 268 and 270 formed in the receiving plate 266, elongated slits 290 and 292 extending widthwise are formed in the bottom wall 250 of the frame member 248. Width restricting members 284 and 286 are mounted on the slits 290 and 292 such that their widthwise positions can be freely adjusted. Each of the width restricting members 284 and 286 has a plate-like main portion extending upwardly from the bottom wall 250, and by holding the main portion and moving it widthwise, the width restricting member can be positioned in place. Conveniently, the width restricting member 284 and the width restricting member 286 are interlocked by a suitable means (not shown) such as a pinion gear and a pair of racks, and move synchronously. Specifically, it is convenient that when the width restricting member 284 is moved by a predetermined amount inwardly (or outwardly) in the widthwise direction, the width restricting member 286 is also moved by the same amount inwardly (or outwardly) in the widthwise direction. If desired, a locking means (not shown) may be annexed for releasably locking the width restricting members 284 and 286 in place. An elongated slit 294 extending in the front-rear direction is formed centrally in the rear portion of the bottom wall 250 of the frame member 248, and paper trailing or rear edge restricting member 288 is mounted on the slit 294 such that its position in the front-rear direction can be adjusted freely (and therefore, its distance from the front wall 252 of the frame member 248 can be adjusted freely). The rear edge restricting member 288 has a rectangular block-like main portion extending upwardly from the bottom wall 250, and by holding the main portion and moving it in the front-rear direction, the restricting member 288 can be positioned in place. If desired, a locking means (not shown) may be annexed for locking releasably the rear edge restricting member 288 in place. The methods of mounting the pair of width restricting members 284 and 286 and the paper trailing or rear edge restricting member 288 on the bottom wall 250 of the frame member 248, the method of interlocking the pair of width restricting members 284 and 286, and the locking means for these restricting members may be the same as those which are known in the so-called universal cassette, for example those described in Japanese Laid-Open Utility Model Publication No. 116330/1984. The disclosure of the above Japanese Laid-Open Utility Model Publication is hereby incorporated by reference in lieu of giving a detailed description thereof.

The mounting and detaching of the copying paper receiving stand 152 on and from the paper receiving stand supporting means 184 formed within the housing 2 are performed in the following manner. With reference to FIGS. 2 and 3, to mount the paper receiving stand 152 on the paper receiving stand supporting means 184, the front end portion of the paper receiving stand 152 is inserted into the housing 2 through the opening 208 formed in the left end wall 206 of the housing 2 and positioned on the horizontal plates 186 and 188 between the upright plates 190 and 192. The paper receiving stand 152 is then advanced substantially horizontally along the horizontal plates 186 and 188. During this advancement, the inner surfaces of the upright plates 190 and 192 guide both side surfaces of the paper receiving stand 152. In mounting the paper receiving stand 152 on the paper receiving stand supporting means 184, the receiving plate elevating member 218 in the receiving plate elevating means 210 is held at its inoperative position shown in FIG. 2, and therefore, does not project upwardly beyond the horizontal plates 186 and 188 (see FIG. 1 also). The pair of width adjusting members 234 and 236 in the width adjusting means 226 are held at their most outward positions in the widthwise direction as shown in FIG. 2, and the actuating pieces 238 and 240 of the width adjusting members 234 and 236 are positioned slightly outwardly of the upright plates 190 and 192 in the widthwise direction. Hence, the advancement of the copying paper receiving stand 152 is never hampered by the receiving plate elevating member 218 and the actuating pieces 238 and 240. When the paper receiving stand 152 has been advanced to a predetermined position (the position shown in FIG. 1), the front end of the paper receiving stand 152 abuts against the upright pieces 194 and 196, and therefore is accurately prevented from advancing further beyond the predetermined position. Immediately before the front end of the paper receiving stand 152 abuts against the upright pieces 194 and 196, the locking protrusions 260 and 262 of the paper receiving stand 152 interfere with the projecting portions 199 and 201 of the locking members 198 and 200 in the paper receiving stand supporting means 184, whereby the locking members 198 and 200 are elastically elevated. When the front end of the paper receiving stand 152 has been advanced until it abuts against the upright pieces 194 and 196, the locking protrusions 260 and 262 go past the projecting portions 199 and 201 of the locking members 198 and 200. As a result, the locking members 198 and 200 elastically return, and as shown in FIG. 2, the projecting portions 199 and 201 of the locking members 198 and 200 engage the rear surfaces of the locking protrusions 260 and 262. As a result, the copying paper receiving stand 152 is accurately prevented from accidentally moving rearwardly from the predetermined position. The paper receiving stand 152 may be detached from the supporting means 184 by pulling it out from the housing 2 through the opening 208 formed in the left end wall 206 of the housing 2. In the early stage of this pulling operation, the locking protrusions 260 and 262 interfere with the projecting portions 199 and 201 of the locking members 198 and 200 whereby the locking members 198 and 200 are elastically elevated. When the locking protrusions 260 and 262 go past the projecting portions 199 and 201 of the locking members 198 and 200, the locking members 198 and 200 return elastically. At the time of detaching the paper receiving stand 152 from the paper receiving stand supporting means 184, the receiving plate elevating member 218 is held at its inoperative position and the pair of width adjusting members 234 and 236 are positioned most outwardly in the widthwise direction. Thus, the rearward movement of the paper receiving stand 152 is not hampered by the receiving plate elevating member 218 and the actuating pieces 238 and 240 of the width adjusting members 234 and 236.

In the illustrated copying apparatus, the size and shape of at least the front end portion of the frame member 248 of the paper receiving stand 152 are substantially the same as the frame members 78 and 103 of the paper cassettes 76 and 102 in the second and third paper feed means 56 and 58 shown in FIG. 1, and in place of the paper receiving stand 152, the paper cassettes 76 or 102 may be detachably mounted on the paper receiving stand supporting means 184. The mounting and detaching of the paper cassettes 76 or 102 on and from the supporting means 184 can be performed in the same way as in the case of the copying paper receiving stand 152.

Operation and advantages of the first embodiment

The operation and advantages of the copying apparatus described hereinabove will be described.

With reference to FIG. 1, in the illustrated copying apparatus, the rotating drum 8 is rotated in the direction of arrow 10, and in the charging zone 12, the surface of the photosensitive member on the rotating drum 8 is charged to a specified polarity by the charging corona discharge device 24. In the preliminary charge eliminating zone 14, the charge on the photosensitive member is eliminated in a region outwardly of the width of a copying paper to be conveyed through the transfer zone 20 (the conveying of the copying paper will be described hereinafter). In the exposing zone 16, the image of a document placed on the transparent plate 4 is scanned and projected onto the photosensitive member by the optical system 40 to thereby form a latent electrostatic image on the photosensitive member. In the developing zone 18, toner is applied to the latent electrostatic image on the photosensitive member by the developing device 28 to develop it to a toner image. In the transfer zone 20, a copying paper sheet conveyed through the transfer zone is brought into contact with the surface of the photosensitive member, and by the action of the transfer corona discharge device 30, the toner image on the photosensitive member is transferred to the copying paper. Then, by the action of the peeling corona discharge device 32, the sheet is peeled from the photosensitive member. The sheet so peeled is conveyed to the pair of heat-fixing rollers and during passage between the rollers 120, the toner image is fixed to the sheet. In the meantime, in the cleaning zone 22, the residual toner is removed from the surface of the photosensitive member by the action of the blade 36.

In order to set the copying apparatus in condition for forming an image on both surfaces of a copying paper sheet is required, it is necessary to mount the paper receiving stand 152 in place on the paper receiving stand supporting means 184 of the housing as shown in FIG. 1.

When an image is to be formed only on one surface of a copying paper in such a condition, the control member 130 in the conveyance control means 126 is held at a first position shown by the two-dot chain lines. A copying paper is fed to the paper conveying passage 64 from one of the first, second and third copying paper feed means 54, 56 and 58. While this copying paper is conveyed through the paper conveying passage 64, a toner image is transferred only to one surface (the upper surface) of the copying paper in the transfer zone 20, and the toner image is fixed to such surface of the paper by the action of the heat-fixing rollers 120. As a result, the image is formed on one surface of the paper. The paper from the conveying passage 64 is conducted to the discharge roller pair 132 after passing over the control member 130, and discharged onto the receiving tray 134. A copy having the image formed on one surface is obtained.

When it is desired to form an image on both surfaces of a copying paper, the control member 130 in the conveyance control means 126 is first held at a second position shown by the solid lines. Then, the paper is fed to the conveying passage 64 from one of the first, second and third paper feed means 54, 56 and 58. During the conveying of the paper through the conveying passage 64, the toner image is transferred to one surface (the upper surface) of the paper in the transfer zone 20.

The toner image is fixed to such one surface of the paper by the action of the heat-fixing roller pair 120, and the image is formed on one surface of the paper. The paper from the conveying passage 64 is introduced into the paper reversing passage 136 while being guided by the control members 130 held at the second position shown by the solid lines. Thus, the paper advances in the direction of an arrow 296 through the paper reversing passage 136. After the trailing end of the paper has gone past the downstream end of the paper conveying passage 64, that is, the nipping site of the conveying roller pair 124, the rotating direction of the reversing roller pair 142 in the paper reversing passage 136 is reversed. Consequently, the paper is moved in the direction of an arrow 298 with its front and rear ends being reversed. The paper is introduced into the paper returning passage 138 from the paper reversing passage 136 and advanced through the paper returning passage 138. The rotating direction of the reversing roller pair 142 in the paper reversing passage 136 is returned to the original one after the paper has been introduced into the paper reversing passage 136.

The paper advancing through the paper returning passage 138 is conducted to the paper receiving stand 152 in the paper receiving and delivering means 150, and moves to the right in FIG. 1 on the receiving stand 152 (more specifically on the bottom wall 250 and the receiving plate 266 of the frame member 248). The delivery roller 166 which abuts against the receiving plate 266 (or the copying paper that has been returned to the receiving plate 266) and rotates counterclockwise acts on the upper surface of the paper to deliver it further to the right, until the leading edge of the paper abuts against the front wall 252 of the frame member 248. As a result, the paper is prevented from further movement and stopped at a predetermined position on the paper receiving stand. Even when the delivery roller 166 is rotated counterclockwise at this time, slippage is produced between the paper and the delivery roller 166, and further movement of the paper is hampered. Then, the delivery roller 166 is elevated to its inoperative position shown by the two-dot chain lines, and the width adjusting members 234 and 236 of the width adjusting means 226 shown in FIG. 2 are moved inwardly in the widthwise direction to a predetermined position (i.e., a position at which the distance between the actuating pieces 238 and 240 corresponds to the width of the paper that has been returned). As a result, the returned paper is accurately held at a predetermined widthwise position by the actuating pieces 238 and 240. Then, the delivery roller 166 is again caused to descend, and the width adjusting members 234 and 236 of the width adjusting means 226 are moved outwardly in the widthwise direction. Consequently, the paper receiving stand 152 is ready for receiving the next paper.

When the required number of copying paper sheets have been returned to the paper receiving stand 152, the control members 130 in the conveyance control means 126 are returned to the first position shown by the two-dot chain lines. Furthermore, the electromagnetic solenoid 220 in the receiving plate elevating means 210 shown in FIG. 2 is energized to pivot the receiving plate elevating member 218 in the direction shown by an arrow 224 (clockwise in FIG. 1). As a result, the receiving plate 266 and the leading portion of the copying paper on it in the paper receiving stand 152 are elevated, whereby the uppermost copying paper sheet is pressed by the delivery roller 166 and the delivery roller 166 itself is slightly elevated. Then, the delivery roller 166 is rotated counterclockwise to deliver the paper to the paper feed passage 174. If required, it is possible at this time to move the width adjusting members 234 and 236 of the width adjusting means 226 to a predetermined position inwardly in the widthwise direction and to prevent the widthwise displacement of the paper by the actuating pieces 238 and 240. The copying paper which has been delivered by the delivery roller 166 is advanced through the paper feed passage 174 by the action of the paper feed roller 158 and again fed into the paper conveying passage 64. The friction pad 160 prevents the feeding of two or more paper sheets at a time into the paper conveying passage 64 through the paper feed passage 174. The paper fed through the paper feed passage 174 is turned upside down as a result of passing through paper re-feeding passage 174 of a nearly semicircular shape, and is fed to the paper conveying passage 64 with its one image-bearing surface being directed downwardly, as can be readily understood from FIG. 1. The paper is then conveyed again through the paper conveying passage 64. At this time, the toner image is transferred to the other surface (upper surface) of the paper in the transfer zone 20, and fixed on the paper by the action of the heat-fixing rollers 120. As a result, the image is formed on the other surface of the paper. The paper is then conducted to the discharge roller pair 132 after passing over the control members 130 held at the second position shown by the two-dot chain lines, and discharged onto the receiving tray 134. Thus, a copy having an image formed on both surfaces can be obtained.

In the formation of an image on both surfaces of a copying paper as above, during returning of the paper to the paper receiving stand 152 through the paper returning passage 138, the paper may jam up in the paper receiving stand 152. In the event of such paper jamming, it is possible to detach the paper receiving stand 152 from the paper receiving stand supporting means 184 in the housing 2, remove the jamming paper from the paper receiving stand 152, and then to mount the paper receiving stand 152 again on the supporting means 184. Accordingly, the removal of the jamming paper and the resumption of the copying operation can be performed sufficiently easily and rapidly.

Figure 5:
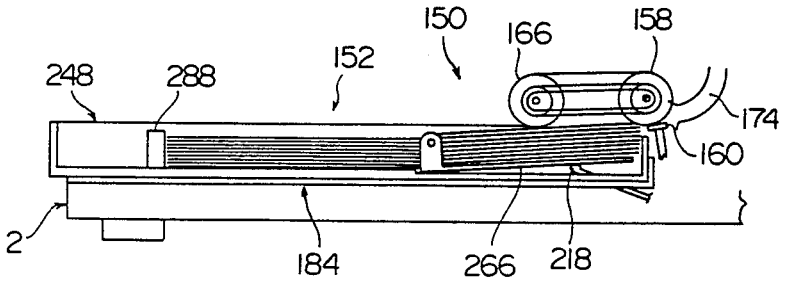
FIG. 5 is a simplified partial sectional view showing the state of the copying apparatus of FIG. 1 in which the copying paper receiving stand is utilized as a universal cassette.

It is seldom desired to form an image on both sides of a copying paper, and frequently, it is desired to form an image only on one surface of the copying paper over a relatively long period of time. In the copying apparatus described above, the paper receiving and delivering means can be used as means for feeding fresh copying paper sheets bearing no image on either surface to the paper conveying passage. When it is not necessary to form an image on both surfaces of the paper but to form it only on one surface of the paper, the paper receiving stand 152 is detached from the supporting means 184 of the housing 2. Then, the pair of width restricting members 284 and 286 and the trailing edge restricting member 288 in the paper receiving stand 152 are held at positions corresponding to copying paper sheets of a desired size, and a layer of copying paper sheets of the desired size is loaded into that portion of the copying paper receiving stand 152 which is defined by the pair of width restricting members 284 and 286 and the trailing edge restricting member 288. The size of these paper sheets may be different from the sizes of copying paper sheets received in the paper cassettes 76 and 102 of the second and third paper feed means 56 and 58 which are of the automatically operating type. Thereafter, as shown in FIG. 5, the paper receiving stand 152 is mounted on the supporting means 184 in the housing 2. The receiving plate elevating member 218 in the receiving plate elevating means 210 is pivoted clockwise in FIG. 5 to elevate the receiving plate 266 and the front portion of the sheets on it in the paper receiving stand 152. As a result, the uppermost paper sheet is pressed by the delivery roller 166 and the delivery roller 166 itself is slightly elevated, whereby the state shown in FIG. 5 is established. In this state, the sheet can be fed to the paper conveying passage 64 through the paper feed passage 174 from the paper receiving stand 152 by rotating the delivery roller 166 selectively. Accordingly, the paper receiving and delivering means 150 loaded with the paper receiving stand 152 having copying paper sheets bearing no image on either surface can be caused to function as an automatically operating-type paper feed means like the second and third paper feed means 56 and 58. Thus, to form an image on one surface of a copying paper, copying paper sheets can be automatically fed to the paper conveying passage 64 selectively not only from the second and third paper feed means 56 and 58 but also from the paper receiving and delivering means 150. In other words, in spite of the provision of only two automatically operating-type paper feed means 56 and 58, sheets of three sizes can be selectively fed automatically to the paper conveying passage 64. This can increase the copying efficiency.

Figure 6:
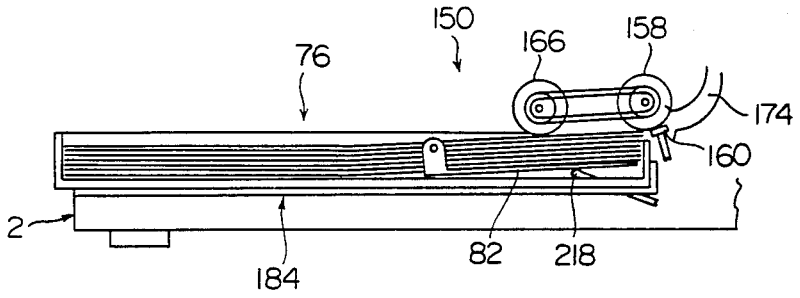
FIG. 6 is a simplified partial sectional view showing the state of the copying apparatus of FIG. 1 in which a copying paper cassette is mounted on the paper receiving stand supporting means.
Figure 7:
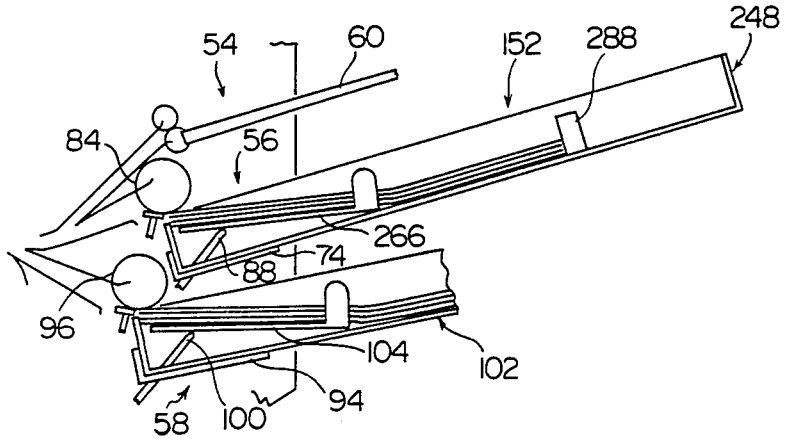
FIG. 7 is a simplified sectional view showing the state of the copying apparatus of FIG. 1 in which the paper receiving stand to be used as a universal cassette is mounted on a second copying paper feed means.

Another noteworthy feature is that in the copying apparatus described above, the size and shape of at least the front end portion of the frame member 248 of the paper receiving stand 152 are made substantially the same as those of the frame members 78 and 103 of the paper cassettes 76 and 102 used in the second and third paper feed means 56 and 58. It is possible therefore to mount the paper cassette 76 (or 102) used for the paper feed means 56 (or 58) on the paper receiving stand supporting means 184 instead of the paper receiving stand 152, and thus to cause the paper receiving and delivering means 150 to serve as an automatically operating-type paper feed means, as shown in FIG. 6. Furthermore, as shown in FIG. 7, the paper receiving stand 152 which can be utilized as a universal cassette can be mounted on the paper cassette supporting means 74 (or 94) of the second (or third) paper feed means 56 (or 58) instead of the paper cassette 76 (or 102).

Modification of the first embodiment

The copying apparatus described above is of the type in which the widthwise position of a copying paper sheet conveyed through the paper conveying passage 64 is restricted in relation to the center, in the widthwise direction, of the photosensitive member on the rotating drum 8. Hence, the pair of width restricting members 284 and 286 are provided in the paper receiving stand 152, and the width adjusting means 266 has the pair of width adjusting members 234 and 236. However, in a copying apparatus of the type in which the widthwise position of the copying paper conveyed through the paper conveying passage 64 is restricted in relation to one side edge, in the widthwise direction, of the photosensitive member on the rotating drum 8, it is possible to provide only one width restricting member in the paper receiving stand 152 and to use a width adjusting means having only one width adjusting member.

In the copying apparatus described above, the receiving plate elevating means 210 is disposed on the paper receiving stand supporting means 184 in the paper receiving and delivering means 150. Alternatively, the receiving plate elevating means may be built in the paper receiving stand 152. In this case, it is convenient to build the receiving plate elevating means also in the paper cassettes 76 and 102.

It is also possible to annex a controllable driving source such as an electric motor to the pair of width restricting members 284 and 286 disposed in the paper receiving stand 152 and to cause the pair of width restricting members 284 and 286 to function also as width adjusting means and thus omit the width adjusting means 266.

Outline of Second Embodiment

Figure 8:
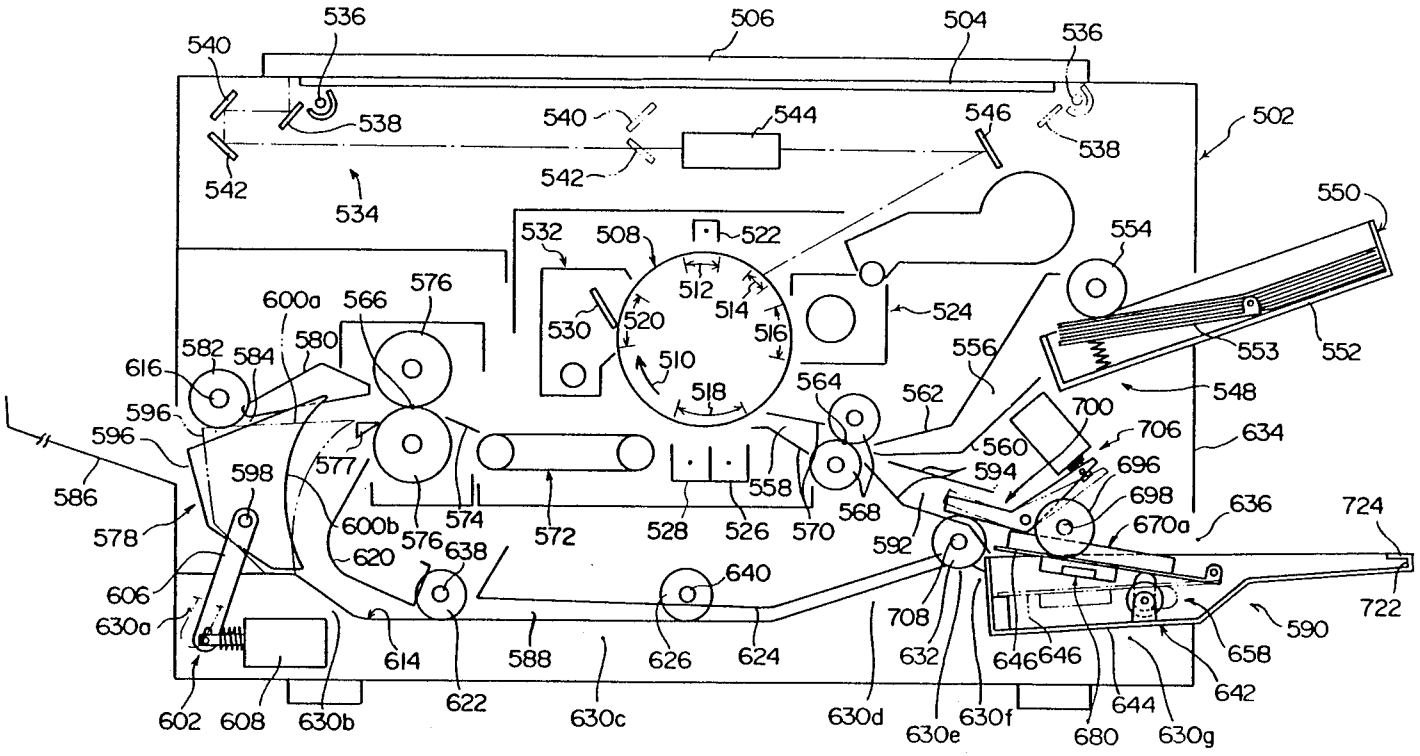
FIG. 8 is a simplified sectional view showing a second embodiment of the copying apparatus constructed in accordance with this invention.

With reference to FIG. 8, a second embodiment of the copying apparatus of this invention will be described briefly.

The copying apparatus shown in FIG. 8 has a nearly parallelpipedal housing 502. On the upper surface of the housing 502 are disposed a stationary transparent plate 504 on which to place a document (not shown) to be copied and an openable-closable document holding member 506 for covering the transparent plate 504 and the document placed theron.

A rotating drum 508 having a photosensitive member on its peripheral surface is mounted rotatably at nearly the central portion of the housing 502. Around the rotating drum 508 to be rotated in the direction of an arrow 510 are defined a charging zone 512, an exposing zone 514, a developing zone 516, a transfer zone 518 and a cleaning zone 510 in this order as viewed in the direction of arrow 510. A charging corona discharge device 252 is disposed in the charging zone 512, and a developing device 524 is disposed in the developing zone 516. A transfer corona discharge device 526 and a peeling corona discharge device 528 are disposed in the transfer zone 518. A cleaning device 532 having a residual toner removing blade 530 is provided in the cleaning zone 520.

An optical system shown generally at 534 is provided above the rotating drum 508. The optical system 534 comprises a movable document illuminating lamp 536, a first movable reflecting mirror 538, a second movable reflecting mirror 540, a third movable reflecting mirror 542, a stationary lens assembly 544 and a stationary reflecting mirror 546. During scanning-exposure operation, the movable document-illuminating lamp 536 and the first movable reflecting mirror 538 are moved at a predetermined velocity V to a predetermined position (for example, a maximum end-of-scan position shown by the two-dot chain lines) substantially horizontally from a start-of-scan position shown by the solid lines, and the second movable reflecting mirror 540 and the third movable reflecting mirror 542 are moved at a velocity half of the aforesaid velocity V (V/2) to a predetermined position (for example, a maximum end-of-scan position shown by the two-dot chain lines) substantially horizontally from a start-of-scan position shown by the solid lines. At this time, the document placed on the transparent plate 504 is illuminated by the movable document-illuminating lamp 536, and the light reflected from the document is successively reflected by the first, second and third movable reflecting mirrors 538, 540 and 542 and reaches the lens assembly 544, from which it is reflected by the stationary reflecting mirror 546 and projected onto the photosensitive member in the exposing zone 514. When the scanning-exposure operation is over, the movable document-illuminating lamp 536 and the first, second and third reflecting mirrors 538, 540 and 542 are returned to the start-of-scan position shown by the solid lines.

A copying paper feed means shown generally at 548 is provided in one end portion (i.e., the right end portion in FIG. 8) of the housing 502. The illustrated paper feed means 548 includes a cassette-receiving section. One of several paper cassettes 550 containing copying paper sheets of different sizes is selectively loaded into the cassette-receiving section. The paper cassette 550 has a box-like main body 552 having an open top, and a paper placing plate 553 mounted pivotally within the main body 552. A delivery roller 554 for delivering copying paper sheets one by one from the loaded paper cassette 550 is disposed in the cassette-receiving section. The paper delivered from the paper cassette 550 loaded in the cassette-receiving section is introduced into a copying paper conveying passage shown generally at 558 through a copying paper delivery passage 556. The paper delivery passage 556 is defined by a guide plate 560 and a guide plate 562. The paper conveying passage 558 extends nearly horizontally from left to right in FIG. 8 all the way from its upstream end 564 to its downstream end 566. The paper conveying passage 558 is defined by a conveying roller pair 568 whose nipping site corresponds to the aforesaid upstream end, a guide plate pair 570, the transfer zone 518 (the area between the rotating drum 508 and the transfer corona discharge device 526 and the peeling corona discharge device 528), a conveyor belt mechanism 572, a guide plate 574, and a heat-fixing roller pair 576 whose nipping site corresponds to the aforesaid downstream end. A peeling member 577 is annexed to the lower heat-fixing roller 576.

A conveyance control means 578 is disposed adjacent to the downstream end of the paper conveying passage 558. The conveyance control means 578 is selectively held at a first position shown by two-dot chain lines in FIG. 8 and a second position shown by solid lines. The conveyance control means 578 will be described in detail hereinafter. Downstream of the conveyance control means 578 is provided a copying paper discharge passage 584 having an upper guide member 580 and a discharge roller 582. A receiving tray 586 is detachably mounted on the other end portion (the left end portion in FIG. 8) of the housing 502.

In relation to the conveyance control means 578, a paper returning passage shown generally at 588 is provided. The paper returning passage 588 extends from its upstream end adjacent to the upstream end of the conveyance control means 578 to the right in FIG. 8 through a space below the paper conveying passage 558. The paper returning passage 588 will be described in detail hereinafter. As can be easily understood from FIG. 8, the conveyance control means 578 at its first position causes the paper conveying passage 558 to communicate with the paper discharge passage 584. At its second position, the conveyance control means 578 permits the paper conveying passage 558 to communicate with the paper returning passage 588.

In the illustrated copying apparatus, a copying paper receiving and delivering means shown generally at 590 is provided downstream of the paper returning passage 588. A copying paper delivering passage shown generally at 592, which extends from the front end of the paper receiving and delivering means 590 to the upstream end 564 of the paper conveying passage 558, is provided above the downstream side portion of the paper returning passage 588. The paper receiving and delivering means 590 receives a copying paper returned through the paper returning passage 588 and delivers it to the upstream end 564 of the paper conveying passage 558 through the paper delivering passage 592. The paper receiving and delivering means 590 will be described in detail hereinafter. The paper delivering passage 592 is defined by a guide plate pair 594.

The general operation of the copying apparatus described above will be described at some length.

The rotating drum 508 is rotated in the direction of arrow 510, and with rotation, a toner image is formed on the photosensitive member of the rotating drum 508 by the action of image-forming means. Specifically, in the charging zone 512, the surface of the photosensitive member on the rotating drum 508 is charged to a specified polarity by the charging corona discharge device 522. In the exposing zone 514, the image of a document placed on the transparent plate 504 is scanned and projected onto the photosensitive member by the optical system 534 to thereby form a latent electrostatic image on the photosensitive member. In the developing zone 516, toner is applied to the latent electrostatic image on the photosensitive member by the developing device 524 to develop the latent electrostatic image to a toner image. The toner image formed on the photosensitive member is then moved to the transfer zone 518 where a copying paper conveyed through the transfer zone 518 (the conveying of the copying paper will be described hereinafter) is brought into contact with the surface of the photosensitive member, and by the action of the transfer corona discharge device 526, the toner image on the photosensitive member is transferred to the paper. Then, by the action of the peeling corona discharge device 528, the paper is peeled from the photosensitive member. The peeled paper is then conveyed to the heat-fixing roller pair 576 and during passage between the rollers 576, the toner image is fixed to the paper. In the meantime, in the cleaning zone 520, the residual toner is removed from the surface of the photosensitive member by the action of the blade 530.

Now, the conveyance of the copying paper sheet will be described. When an image is to be formed only on one surface of the paper, the conveyance control means 578 is held at the first position shown by the two-dot chain lines. The paper introduced into the paper conveying passage 558 from the paper cassette 550 loaded in the cassette-receiving section is conveyed through the paper conveying passage 558. During this time, the toner image is transferred to one surface (the upper surface) of the paper in the transfer zone 518. The toner image is fixed to such surface of the paper by the action of the heat-fixing roller pair 576, whereby the image is formed on one surface of the paper. Then, the paper is introduced into the paper discharge passage 584 from the paper conveying passage 558 while being guided by the conveyance control means 578, and is then discharged into the receiving tray 586 via the paper discharge passage 584. As a result, a copy bearing an image on one surface is obtained.

In the case of forming an image on both surfaces of a copying paper, the conveyance control means 578 is first held at the second position shown by the solid lines. When the copying process is started, the paper introduced into the conveying passage 558 from the cassette 550 loaded in the cassette-receiving section is conveyed through the paper conveying passage 558. During this time, the toner image is transferred to one surface (the upper surface) of the paper in the transfer zone 518, and fixed to such one surface of the paper by the action of the heat-fixing roller pair 576. As a result, the image is formed on one surface of the paper. The paper from the paper conveying passage 558 is guided by the conveyance control means 578 and introduced into the paper returning passage 588. It passes through the paper returning passage 588 and is received properly by the paper receiving and delivering means 590.

When the required number of copying paper sheets have been returned to the paper receiving and delivering means 590, the conveyance control means 578 is returned to the first position. Then, the paper received by the paper receiving and delivering means 590 is delivered to the paper delivering passage 592. The paper delivered to the paper delivering passage 592 is advanced through the paper delivery passage 592 and again fed into the paper conveying passage 558. It will be easily understood from FIG. 8 that the paper is turned upside down as a result of being conveyed through the paper returning passage 588 and the paper delivering passage 592, and fed to the paper conveying passage 558 with its image-bearing side directed downwardly. The paper is then conveyed through the paper conveying passage 558. At this time, the toner image is transferred to the other surface (upper surface) of the paper in the transfer zone 518 and fixed to it by the action of the heat-fixing roller pair 576. As a result, the image is formed on the other surface of the paper. The paper is then guided by the conveyance control means 578 from the paper conveying passage 558 and introduced into the paper discharge passage 584. Finally, it is discharged onto the receiving tray 586 via the paper discharge passage 584. As a result, a copy having an image formed on both surfaces is obtained.

The structure and operation of the illustrated copying apparatus described hereinabove do not constitute the novel improved features of the present invention, but merely show one example of the copying apparatus to which the invention can be applied. A detailed description of these will therefore be omitted in the present specification.

Figure 9:
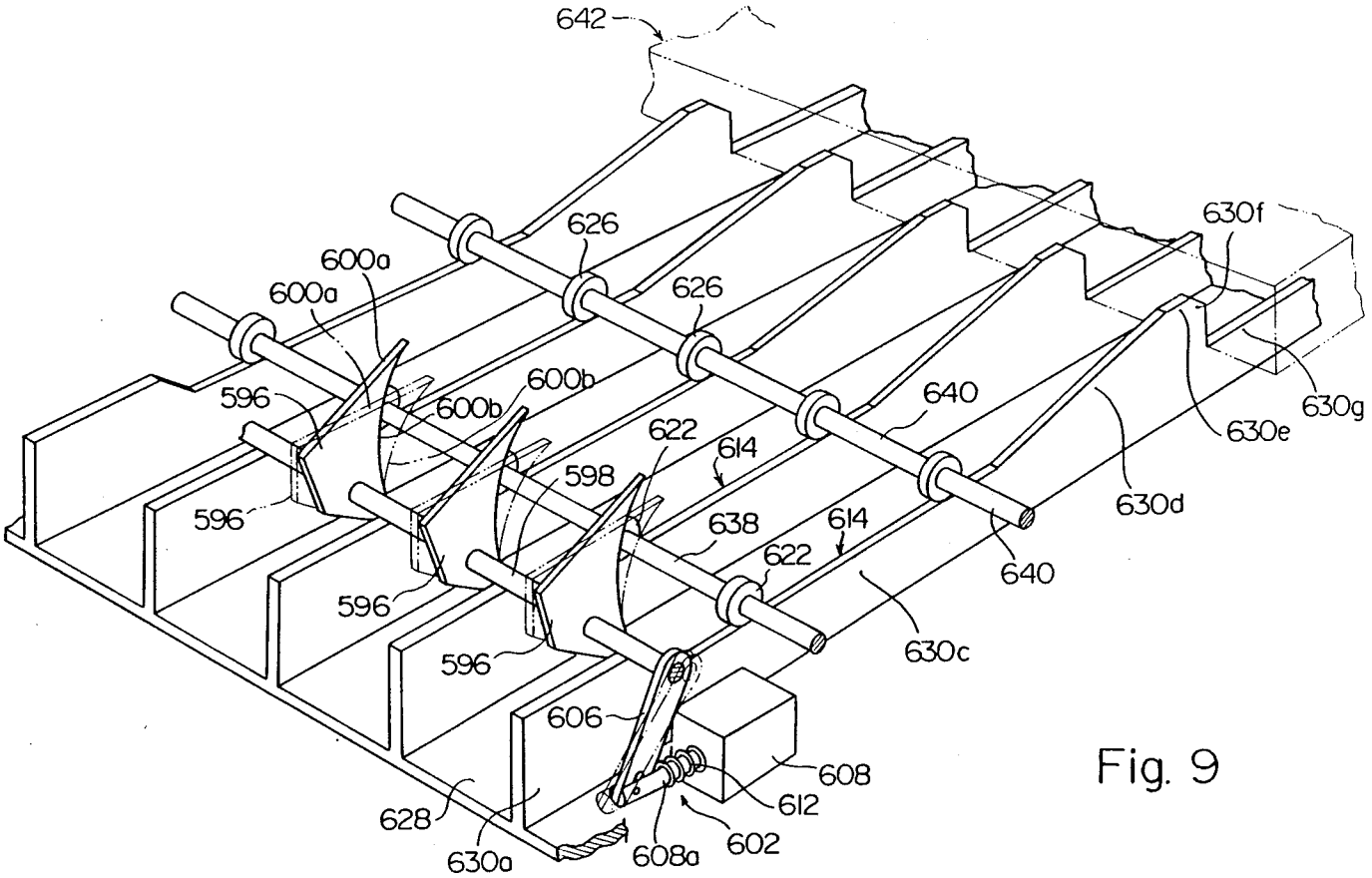
FIG. 9 is a partial perspective view showing the copying paper returning passage of the copying apparatus of FIG. 8.

Structure of the conveyance control means and related elements in the second embodiment of the invention With reference to FIGS. 8 and 9, the illustrated conveyance control means 578 includes plate members 596 for conducting a copying paper sheet in the required manner. A front base plate and a rear base plate (both not shown) are disposed with a space therebetween in the front-rear direction (the direction perpendicular to the sheet surface in FIG. 8, and the direction from right bottom toward left top in FIG. 9) within the housing 502 of the copying apparatus. A supporting shaft 598 is rotatably mounted across the front base plate and the rear base plate, and a plurality of plate members 596 are fixed to the supporting shaft 598 in spaced-apart relationship in the front-rear direction (i.e., the widthwise direction). Each of the plate members 596 is nearly triangular, and as will be described hereinafter, its upper edge 600*a* and its front edge 600*b* act as guiding surfaces. In relation to these plate members 596, a plate member pivoting means 602 is annexed for controlling the conveyance of a copying paper by pivoting the plate members 596. The illustrated plate member pivoting means 602 has a lever member 606, and an electromagnetic solenoid 608. One end portion of the lever member 606 is fixed to one forwardly extending end portion of the supporting shaft 598. The other end portion of the lever member 606 is linked to the output terminal portion 608*a* of the electromagnetic solenoid 608 via a pin member so as to permit the pivoting of the lever member 606 which is to be described later. A coil spring 612 is interposed between the main body of the electromagnetic solenoid 608 and the lever member 606 in such a manner that it is received about the output terminal portion 608*a*. Hence, when the electromagnetic solenoid 608 is in the deenergized state, each of the plate members 596 is held at the first position shown by the two-dot chain lines in FIGS. 8 and 9 by the action of the coil spring 612 (when it is held at the first position, the lower edge of each plate member 596 abuts against the upper end surface of a corresponding protrusion 614). When the electromagnetic solenoid 608 is energized, each of the plate members 596 is pivoted counterclockwise in FIGS. 8 and 9 as a unit with the supporting shaft 598 via the lever member 606, and held at the second position shown by the solid lines in FIGS. 8 and 9.

The upper guide member 580 and the discharge roller 582 defining the paper discharge passage 584 are disposed above the conveyance control means 578. In the illustrated embodiment, a plurality of upper guide members 580 are disposed downstream of the heat-fixing roller pair 576. Each of the upper guide membes 580 is arranged between adjacent plate members 596, and the plate members 596 are spaced from each other in the widthwise direction (the direction perpendicular to the sheet surface in FIG. 8, and the direction from right bottom toward left top in FIG. 9). With reference mainly to FIG. 8, the discharge roller 582 is disposed downstream of the upper guide members 580. A rotating shaft 616 rotated in a predetermined direction is disposed above the rear portions of the plate members 596, and a plurality of discharge rollers 582 are mounted on the rotating shaft 616 in spaced-apart relationship in the front-rear direction. The discharge rollers 582 are provided correspondingly to the plate members 596 respectively in the illustrated embodiment.

It is seen from FIG. 8 that because of the aforesaid structure, when the plate members 596 are at the first position, the upper edge 600*a* of each of the plate members 596 extends toward the vicinity of the nipping site of the heat-fixing roller pair 576 substantially horizontally, and the rear part of its upper edge 600*a* is caused to abut against the corresponding discharge roller 582. Hence, the copying paper discharged from the heat-fixing roller pair 576 passes between the upper edge 600*a* of the plate members 596 and the upper guide members 580, is further conveyed downstream by being guided by the upper edges 600*a* of the plate members 596, and is discharged out of the housing by the cooperative action of the discharge rollers 582 and the upper edges 600*a* of the plate members 596. On the other hand, when the plate members 596 are at the second position, the front end portions of the upper edges 600*a* of the plate members 596 extend through the paper discharge passage 584 and are positioned between the upper guide members 580 whereby the paper discharge passage 584 is substantially closed. Hence, the paper discharged from the heat-fixing roller pair 576 is not conveyed to the paper discharge passage 548, but is introduced into the paper returning passage 588 by being guide by part of the upper guide members 580 and the front edges 600*b* of the plate members 596.

Thus, in a copying apparatus equipped with the conveyance control means 578 of the above construction, the copying paper conveyed through the paper conveying passage 558 can be selectively discharged out of the housing 502 or introduced into the paper returning passage 588 with a relatively simple construction.

Structure of the paper returning passage in the second embodiment

Again with reference to FIGS. 8 and 9, the structure of the paper returning passage 588 will be described. In the illustrated embodiment, the paper returning passage 588 extends from left to right in FIG. 8 below the paper conveying passage 558 and the paper delivering passage 592. Its one side is defined by the front edges 600*b* of the plate members 596 and the protrusions 614 provided on the bottom wall 628 of the housing 502, and its other side, by a guide plate 620, return rollers 622, a guide plate 624 and return rollers 626. The front base plate and the rear base plate are mounted on the upper surface of the bottom wall 628 of the housing 502 in spaced-apart relationship in the front-rear direction, and the aforesaid structural elements are disposed between the front base plate and the rear base plate. In the illustrated embodiment, a plurality of protrusions 614 are provided on the upper surface of the bottom wall 628 in spaced-apart relationship in the front-rear direction, namely in the widthwise direction of the paper returning passage 588. The protrusions 614 are formed as a one-piece unit with the bottom wall 628 made of a synthetic resin. Each of the protrusions 614 extends from the left end to the right end of the housing 502 in FIG. 8, and corresponds to each of the plate members 596 of the conveyance control means 578. Each of the protrusions 614 has a left projecting horizontal portion 630*a*, a left inclined portion 630*b*, an intermediate horizontal portion 630*c*, a right inclined portion 630*d*, a right projecting horizontal short portion 630*e*, a right inclined short portion 630*f*, and a right step portion 630*g* from left to right in FIGS. 8 and 9. The upper edge of the left projecting portion 630*a* extends from the left end of the housing 502 to the right in FIG. 8 substantially horizontally, and above it, the corresponding plate member 596 is disposed. The upper edge of the left inclined portion 630*b* is inclined downwardly to the right in FIG. 8 from the right end of the left projecting horizontal portion 630*a*. The upper edge of the left inclined portion 630*b*, in cooperation with the front edge 600*b* of the plate member 596 at the second position, defines a substantially continuous nearly arcuate guide surface. The upper edge of the intermediate horizontal portion 630*c* extends substantially horizontally to the right in FIG. 8 from the right end of the left inclined portion 630*b*. The upper edge of the right inclined portion 630*d* is inclined upwardly to the right in FIG. 8 from the right end of the intermediate horizontal portion 630*c*. The upper edge of the right projecting horizontal short portion 630*e* extends substantially horizontally to the right in FIG. 8 from the right end of the right inclined portion 630*d*. The upper edge of the right projecting horizontal short portion 630*e* permits contacting of a return roller 632 (FIG. 8) (to be described) therewith. The upper edge of the right inclined short portion 630*f* extends downwardly to the right in FIG. 8 from the right end of the right projecting horizontal short portion 630*e*. The right step portion 630*g* is provided at the right end of the right inclined end portion 630*f*, and its upper edge extends substantially horizontally, or slightly inclined upwardly, from the right end of the right inclined short portion to the right end of the housing 502. It will be seen from FIGS. 8 and 9 that the right step portion 630*g* defines a receiving portion for receiving the paper receiving and delivering means 590, and the paper receiving and delivering means 590 is mounted detachably on the receiving portion through an opening 636 formed in the right wall 634 of the housing 502.

The illustrated embodiment has the following construction in relation to the plurality of protrusions 614. With reference mainly to FIG. 8, the guide plate 620 is disposed opposite to the front edges 600*b* of the plate members 596 and the left inclined portions 630*b* of the protrusions 614. The guide plate 624 is disposed above the intermediate horizontal portions 630*c* and the right inclined portions 630*d* of the protrusions 614. Between the guide plates 620 and 624 is provided a rotating shaft 638, and a plurality of return rollers 622 are mounted on the rotating shaft 638. Each of the return rollers 622 corresponds to a respective one of the protrusions 614 provided on the bottom wall 628 in spaced-apart relationship in the axial direction of the rotating shaft 638 (FIG. 9). The rotating shaft 638 is rotated in a predetermined direction, and each return roller 622, in cooperation with the corresponding protrusion 614, returns the copying paper to the right in FIG. 8. A rotating shaft 640 extending widthwise is disposed above the guide plate 624, and a plurality of return rollers 626 are mounted on the rotating shaft 640. Each of the return rollers 626 also corresponds to a respective one of the protrusions 614 provided at intervals in the axial direction of the rotating shaft 640 (FIG. 9). The rotating shaft 640 is rotated in a predetermined direction, and each of the return rollers 626, in cooperation with the corresponding protrusion 614, returns the copying paper. In the specific embodiment shown in the drawings, an opening (not shown) through which the lower portion of the return roller 626 can project downwardly is formed at that site of the guide plate 624 which corresponds to the return roller 626 so that the return roller 626 can cooperate with the protrusion 614. As will be described in detail hereinbelow, a return roller 632 rotating in a predetermined direction is disposed correspondingly to the right projecting short portion 630*e* of each of the protrusions 614 (see FIG. 11 also). Each of the return rollers 632 cooperates with the corresponding protrusion 614 and returns the copying paper.

As is understood from FIG. 8, one side (lower side) of the paper returning passage 588 is defined by the front edges 600*b* of the plate members 596 and the left inclined portions 630*b*, the intermediate horizontal portions 630*c*, the right inclined portions 630*d*, the right projecting horizontal short portions 630*e* and the right inclined short portions 630*f* of the protrusions 614, and the other side is defined by the guide plate 620, the return rollers 622, the guide plate 624, the return rollers 626 and the return rollers 632. Accordingly, when the plate members 596 of the conveyance control means 578 are held at the second position, the copying paper discharged from the heat-fixing roller pair 576 is guided by the front edges 600*b* of the plate members 596 and introduced into the paper returning passage 588. The copying paper so introduced passes through the protrusions 614 and the guide plate 620 and is conveyed to the return rollers 622, and by the cooperative action of the return rollers 622 and the protrusions 614, it is conveyed to the return rollers 626 via the space between the protrusions 614 and the guide plate 624. Furthermore, the copying paper is conveyed to the return rollers 632 through the space between the protrusions 614 and the guide plate 624 by the cooperative action of the return rollers 626 and the protrusions 614. Thereafter, by the cooperative action of the return rollers 632 and the protrusions 614, it is received properly by the copying paper receiving and delivering means 590.

Since in the copying apparatus of the above constructions, at least a part of the paper returning passage 588 is defined by the protrusions 614 formed as a one-piece unit with the plastic bottom wall 628, the structure of the copying apparatus, particularly the structure of parts related to the paper returning passage 588, can be much simplified, and the cost of production can be reduced.

Figure 10:
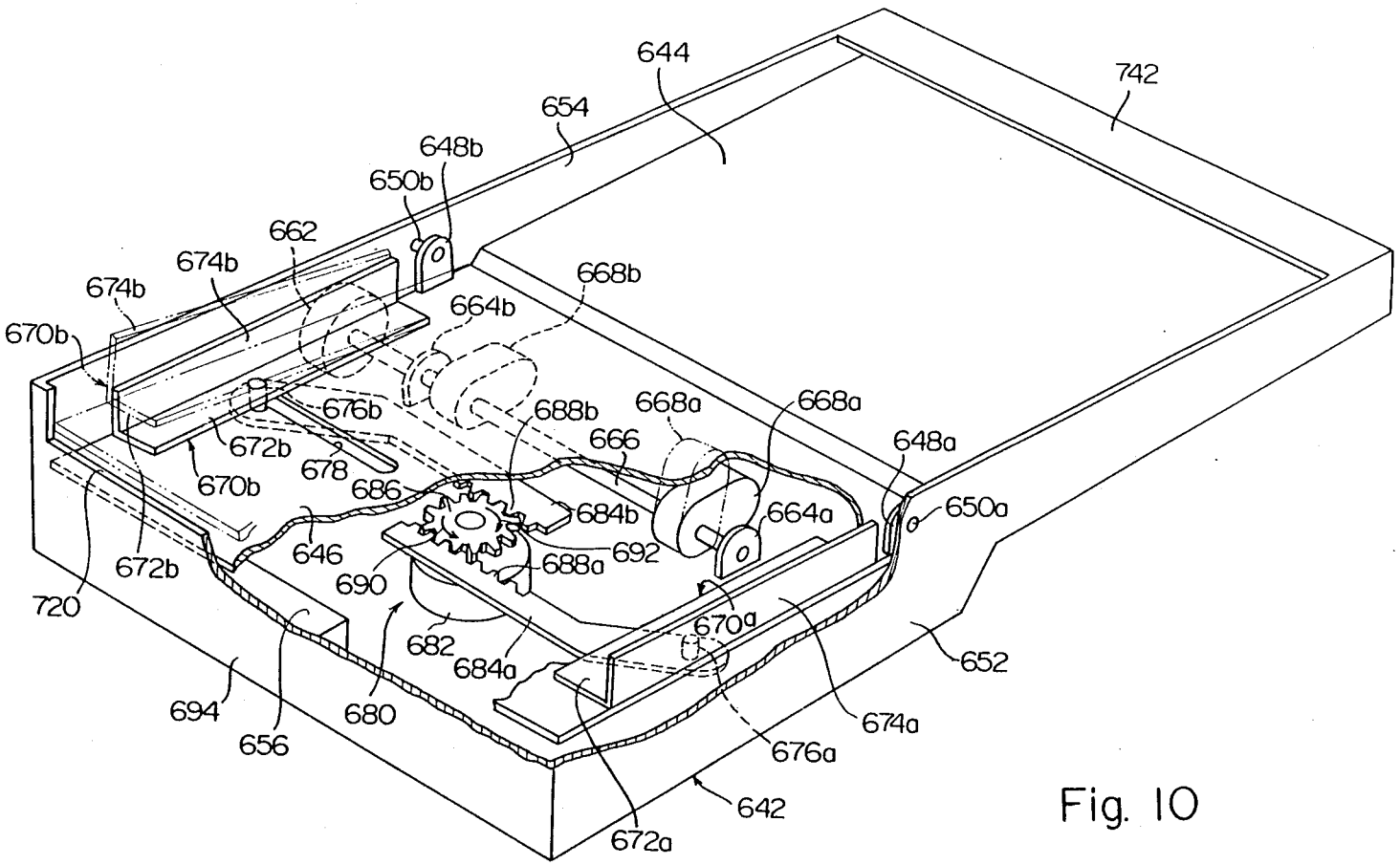
FIG. 10 is a perspective view, partly broken away, of the copying paper receiving and delivering means of the copying apparatus of FIG. 8.

Structure of the paper receiving and delivering means and related elements in the second embodiment The structure of the paper receiving and delivering means 590 will be described with reference to FIGS. 8 and 10. The paper receiving and delivering means 590 mounted detachably on the housing 502 has a box-like frame member 642 with an open top. The bottom wall 644 of the frame member 642 has a front portion projecting at a lower level than its rear portion, whereby an accommodating space to be described is defined in the front lower portion of the frame member 642. A receiving plate 646 is disposed in the front portion of the frame member 642. Upwardly extending projecting portions 648*a* and 648*b* are provided integrally at both side ends of the rear end portion of the receiving plate 646, and are pivotably mounted on side walls 652 and 654 of the frame member 642 via pin members 650*a* and 650*b*. Accordingly, the receiving plate 646 is pivotable between the position shown by the two-dot chain lines in FIG. 8 and the solid lines in FIG. 10 and the position shown by the solid lines in FIG. 8 and the two-dot chain lines in FIG. 10. In relation to the receiving plate 646, a stop block 656 is fixed to the upper surface of the front end of the bottom wall 644. The stop block 656 acts on the lower surface of the front end of the receiving plate 646 to prevent the receiving plate 646 surely from pivoting counterclockwise in FIGS. 8 and 10 beyond a receiving position shown by the two-dot chain lines in FIG. 8 and the solid lines in FIG. 10. Hence, the receiving plate 646 is normally held accurately at the receiving position by its own weight. At the receiving position, the receiving plate 646 together with the rear portion of the bottom wall 644 of the frame member 642 define a substantially continuous plane. A copying paper is received, or loaded by a manual operation, onto this plane, i.e. the receiving plate 646 and the upper surface of the rear portion of the bottom wall 644, (therefore, the receiving plate 646 and the rear portion of the bottom wall 644 constitute a paper receiving stand). Below the receiving plate 646 is defined an accommodating space as shown in FIGS. 8 and 10 which permits the provision of a receiving plate elevating means 658, etc. below the receiving plate 646.

The receiving plate elevating means 658 comprises a pair of elevating members and an elevating member positioning means such as a stepping motor 662. A pair of supporting brackets 664*a* and 664*b* are provided on the upper surface of the front portion of the bottom wall 644 of the frame member 642 in spaced-apart relationship in the widthwise direction of the frame member 642 (the direction perpendicular to the sheet surface in FIG. 8, and the direction from right bottom toward left top in FIG. 10). A supporting shaft 666 is rotatably mounted across the supporting brackets 664*a* and 664*b*, and a pair of elevating members 668*a* and 668*b*, axially spaced from each other, are fixed to the supporting shaft 666. The elevating members 668*a* and 668*b* are nearly elliptical, and one end portion of each of them is fixed to the supporting shaft 666. The supporting shaft 666 extends upwardly to the left in FIG. 10 through the supporting bracket 664*b*, and the stepping motor 662 is mounted on the projecting end portion of the supporting shaft 666. Accordingly, when by the rotation of the stepping motor 662, the elevating members 668*a* and 668*b* are held at an inoperative position shown by the two-dot chain lines in FIG. 8 and the solid lines in FIG. 10 (at the inoperative position, the elevating members 668*a* and 668*b* extend toward the rear end portion of the frame member 642), the elevating members 668*a* and 668*b* move away from the receiving plate 646 and are positioned therebelow, and the receiving plate 646 is held at the receiving position by the abutment of its front end against the stop block 656. On the other hand, when the elevating members 668*a* and 668*b* are held at an operating position (at which the elevating members 668*a* and 668*b* extend upwardly of the frame member 642) shown by the solid lines in FIG. 8 and the two-dot chain lines in FIG. 10 (FIG. 10 shows only the elevating member 668*a* at the two-dot chain line position) by the rotation of the stepping motor 662, the other end portions of the elevating members 668*a* and 668*b* act on the lower surface of the receiving plate 646 to pivot the receiving plate 646 clockwise in FIGS. 8 and 10 about the pin members 650*a* and 650*b* as a center, and consequently, the front portion of the receiving plate 646 is elevated as shown by the solid lines in FIG. 8 and the two-dot chain lines in FIG. 10.

A pair of width restricting members 670*a* and 670*b* are provided movably in the widthwise direction on the upper surface of the receiving plate 646 which is mounted so as to be free to ascend as described above. In the specific embodiment shown in the drawings, the width restricting members 670*a* and 670*b* have a nearly L-shaped vertical section and respectively have base portions 672*a* and 672*b* contacting the upper surface of the receiving plate 646 and restricting portions 674*a* and 674*b* extending upwardly from the base portions 672*a* and 672*b*. Downwardly projecting pin members 676*a* and 676*b* are fixed to the lower surfaces of the base portions 672*a* and 672*b*. A pair of elongated holes 678 (only one of which is shown in FIG. 10) extending widthwise are formed in the receiving plate 646, and the pin members 676*a* and 676*b* are received in the elongated holes 678 in such a manner that they can slide freely along the holes 678. A moving means 680 for moving the pair of width restricting members 670*a* and 670*b* is further provided in the receiving plate 646. In the illustrated embodiment, the moving means 680 includes a stepping motor 682 and a pair of moving members 684*a* and 684*b*. The stepping motor 682 is mounted in place on the under surface of the receiving plate 646, and a pinion 686 is fixed to its output shaft. The pair of moving members 684*a* and 684*b* are arranged such that the pinion 686 is interposed therebetween. One moving member 684*a*, in relation to the width restricting member 670*a*, is mounted on the under surface of one side of the receiving plate 646 by a guide member (not shown) so as to be free to move in the widthwise direction. A rack portion 688*a* is formed on the rear side surface of the inside end portion of the moving member 684*a*, and meshes with one side of the pinion 686. To the outside end portion of the moving member 684*a* is linked the projecting end of the pin member 676*a* projecting downwardly through the other elongated hole 678 (not shown) of the receiving plate 646. The other moving member 684*b*, in relation to the width restricting member 670*b*, is mounted for free widthwise movement on the under surface of the other side of the receiving plate 646 by a guide member (not shown). A rack portion 688*b* is formed in the front side surface of the inside end portion of the moving member 684*b*, and meshes with the other side of the pinion 686. To the outside end portion of the moving member 684*b* is linked the projecting end of the pin member 676*b* projecting downwardly through the elongated hole 678 of the receiving plate 646. Thus, when the pinion 686 is rotated in the direction shown by an arrow 690 (or 692) in FIG. 10 by the action of the stepping motor 682, one moving member 684*a* is moved downwardly to the right (or upwardly to the left) in FIG. 10 and the other moving member 684*b* is moved upwardly to the left (or downwardly to the right) in FIG. 10. As a result, the pair of width restricting members 670*a* and 670*b* are moved outwardly (or inwardly) in the widthwise direction, and the distance between them becomes larger (or smaller).

The copying apparatus to which the paper receiving and delivering means 590 described above is applied is of the type in which the widthwise position of a copying paper conveyed through the paper conveying passage 558 is restricted in relation to the widthwise center of the photosensitive member on the rotating drum 508. Accordingly, the pair of width restricting members 670*a* and 670*b* are provided on the receiving plate 646. However, in a copying apparatus of the type in which the widthwise position of a copying paper conveyed through the paper conveying passage 558 is restricted in relation to one side edge, in the widthwise direction, of the photosensitive member on the rotating drum 508, the provision of only one width restricting member in the receiving plate 646 suffices.

The paper receiving and delivering means 590 described above is mounted on the housing 502 as shown in FIGS. 8 and 9. Specifically, the front portion of the frame member 642 is inserted into the housing 502 through an opening 636 formed in the right wall 634 of the housing 502 to cause its front wall 694 to abut against the left end abutting surface of the step portions 630*g* of the protrusions 614 and at the same time, place its bottom wall 644 on the upper edges of the step portions 630*g*. As a result, the frame member 642 is detachably mounted on the receiving portion (defined by the step portions 630*g* of the protrusions 614). It can be understood from FIG. 8 that in this mounting state, the rear portion of the frame member 642 projects outwardly from the right wall 634 of the housing 502. Accordingly, in the event of paper jamming in the paper receiving and deliveing means 590 at the time of receiving or delivering a copying paper, the jamming paper can be easily removed from the opening 636 formed in the right wall 634 of the housing 502 (the paper can more easily be removed by detaching the frame member 642 from the housing 502).

The illustrated paper receiving and delivering means 590 further includes a paper delivery roller 696. As shown in FIG. 8, the delivery roller 696 is mounted on a rotating shaft 698 disposed rotatably above the receiving portion of the housing 502. The delivery roller 696 is positioned above the receiving plate 646 when the frame member 642 is mounted detachably on the housing 502. Hence, when the elevating members 668*a* and 668*b* of the receiving plate elevating means 658 are brought to the aforesaid operating position by mounting the frame member 642 detachably, the front portion of the receiving plate 646 is elevated, and its upper surface (or a copying paper when it is present on the receiving plate 646) is pressed by the delivery roller 696. To maintain the pressing force of the delivery roller 696 constant, the elevating members 668*a* and 668*b* are desirably made of a material having some elasticity.

Figure 11:
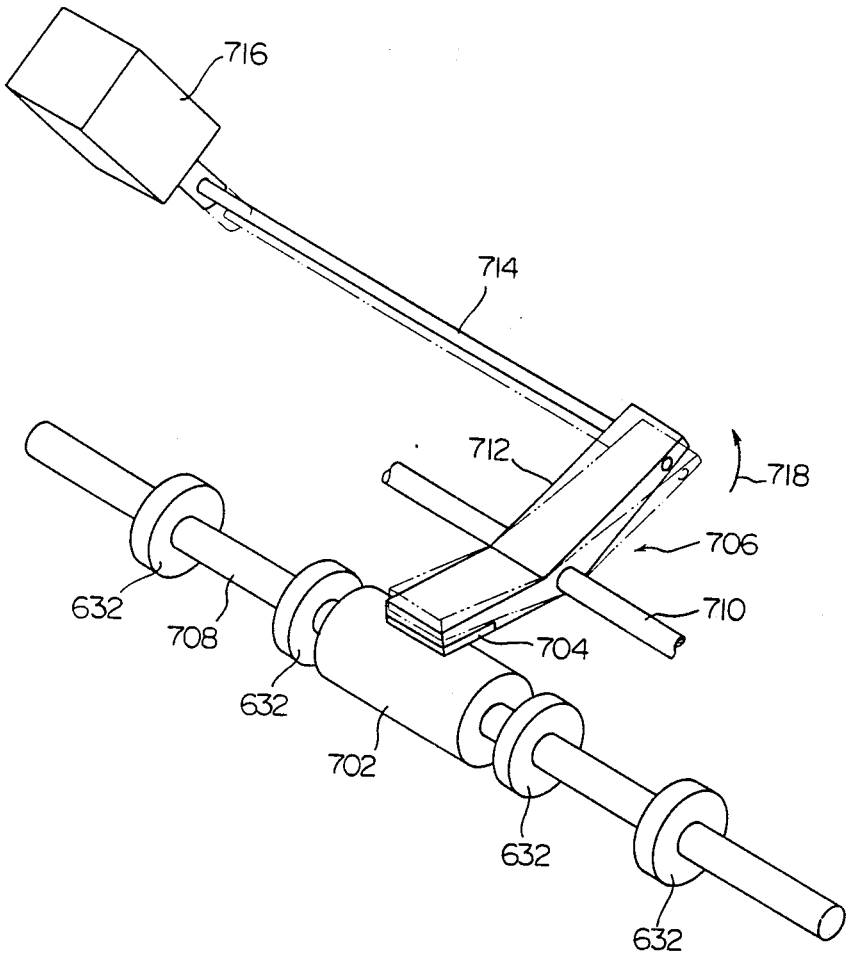
FIG. 11 is a partial perspective view showing means for preventing delivery of two or more papers at a time in the copying apparatus of FIG. 8.

In relation to the paper receiving and delivering means 590, the paper delivery passage 592 further has provided therein means 700 for preventing delivery of two or more paper sheets at a time. With reference to FIGS. 8 and 11, the means 700 comprises a roller 702 to be rotated in a predetermined direction and a friction pad 704 for preventing the delivery of two or more paper sheets at a time in cooperation with the roller 702, and in relation to the friction pad 704, a friction pad positioning means 706 is annexed. In the illustrated embodiment, a rotating shaft 708 extending in the widthwise direction of the paper delivery passage 592, namely in the direction perpendicular to the sheet surface in FIG. 8, is rotatably mounted below the lower guide plate 594 defining the underside of the delivery passage 592, and the roller 702 is mounted in the central part, in the axial direction, of the rotating shaft 708. The friction pad positioning means 706 has a pivoting supporting member 712 mounted pivotably via a shaft member 710, and the friction pad 704 is provided at one end portion of the pivoting supporting member 712. The friction pad may be formed of a material having a high coefficient of friction such as a woven fabric. The other end portion of the supporting member 712 is linked to the output terminal of an electromagnetic solenoid 716 through a linking rod 714. Accordingly, when the electromagnetic solenoid 716 is in the deenergized state, the pivoting supporting member 712 is held at an angular position shown by the two-dot chain lines in FIGS. 8 and 11 by a spring member (not shown), and the friction pad 704 is held at an inoperative position (the position shown by the two-dot chain lines in FIGS. 8 and 11) at which it is apart from the roller 702. Energization of the electromagnetic solenoid 716 causes the pivoting supporting member 712 to pivot in the direction shown by an arrow 718 (FIG. 11) about the shaft member 710 as a center via the linking rod 714. Consequently, the friction pad 704 is held at an operating position shown by the solid lines in FIGS. 8 and 11 and pressed against the peripheral surface of the roller 702.

In the illustrated embodiment, the return rollers 632 are mounted on the rotating shaft 708 on which the roller 702 is mounted, as shown clearly in FIG. 11. More specifically, the return rollers 632 defining the upper side of the downstream end portion of the paper returning passage 588 are mounted at fixed intervals on both sides of the mounting site of the roller 702 on the rotating shaft 708. These return rollers 632 are arranged to correspond to the protrusions 614, more specifically the right projecting horizontal short portions 630*e*, provided on the bottom wall 628 (FIG. 9). The outside diameter of each of the return rollers 632 is substantially equal to that of the roller 702, but its width is smaller than that of the roller 702. Accordingly, the return rollers 632 act on the upper surface of the copying paper returned through the paper returning passage 588, and in cooperation with the right projecting horizontal short portions 630e, return the paper toward the paper receiving and delivering means 590. On the other hand, the roller 702 positioned between two adjacent protrusions 614 hardly acts on the paper returned through the paper returning passage 588, but acts on the lower surface of the paper delivered from the paper receiving and delivering means 590 and conveys it toward the paper conveying passage 558.

In the illustrated copying apparatus, the structure of the paper returning passage 588 can be particularly simplified because the return rollers 632 defining part of the paper returning passage 588 are mounted on the rotating shaft 708 on which the roller 702 of the means 700 for preventing the delivery of two or more copying papers at a time is mounted. Furthermore, since the return rollers 632 are arranged to correspond to the protrusions 614 and the roller 702 is disposed between two adjacent protrusions 614, the function of the roller 702 and the friction pad 704 to prevent delivery of two or more papers at a time is not reduced.

It will be appreciated from FIG. 8 that the paper receiving and delivering means 590 can properly receive the paper returned through the paper returning passage 588 at the paper receiving stand (the front portion of which is defined by the receiving plate 646 and the rear portion of which is defined by the rear portion of the bottom wall 644 of the frame member 642), and also copying paper sheets can be loaded manually onto the paper receiving stand through the opening 636 from outside the housing 502. When a copied image is to be formed on both surfaces of a copying paper, the paper receiving and delivering means 590 properly receives the paper returned through the paper returning passage 588, and thereafter, delivers it to the paper conveying passage 558 in a direction opposite to the direction of returning the paper through the paper returning passage 588. In the illustrated embodiment, a recess 720 (FIG. 10) for paper passage is formed in the upper portion of the front wall 694 of the frame member 642 so that the paper returned through the paper returning passage 588 may be properly received by the frame member 642. Preferably, a slightly forwardly projecting wall 724 (FIGS. 8 and 10) is provided in the upper end of the rear wall 722 (FIG. 8) of the frame member 642 so that the paper may not project outwardly of the rear end of the frame member 642 when received by the frame member 642. Manual loading of copying paper sheets can be effected by inserting the paper sheets into the frame member 642 through the upper surface of the rear portion of the frame member 642 which projects to the right from the right wall 634 of the housing 502, and positioning them in place on the paper receiving stand. The paper receiving and delivering means 590 delivers the manually loaded paper to the paper conveying passage 558.

Control system of the copying apparatus in the second embodiment

Now, with reference to FIG. 12, a control system in the copying apparatus shown in the drawings will be described. The illustrated copying apparatus includes a control means 726 for controlling the various elements of the copying apparatus in the manner described hereinabove. In relation to the control means 726, the copying apparatus is provided with an operating panel 728 as shown in FIG. 13. The operating panel 728 comprises a copying start button 730, a copy number displaying portion 732, a clear button 734 for setting the copying apparatus in the initial condition, a manual switch means 736 for paper size selection, a manual selection switch means 738 and a copying mode selection switch means 740.

The paper size selection manual switch means 736 has three switches 742, 744 and 746. The switch 742 serves to set the distance between the width restricting members 670a and 670b in the paper receiving and delivering means 590 at a value corresponding, for example, to JIS A4 size. The switch 744 serves to set the aforesaid distance, for example, at JIS B4 size, and the switch 746 serves to set the above distance at, for example, JIS B5 size.

The manual selection switch means 738 has two switches 748 and 750, and in relation to these switches, display lamps 752 and 754 are annexed. The switch 748 serves to deliver the paper from the paper feed means 548 located above, and the switch 750 serves to deliver the paper from the paper receiving and delivering means 590 located below.

The copying mode selection switch means 740 has two switches 756 and 758, and in relation to these switches, display lamps 760 and 762 are annexed. The switch 756 serves to select a one-surface copying mode, and the switch 758, to select a both-surfaces copying mode.

Signals from the copying start button 730, the clear button 734, the paper size selection manual switch means 736, the manual selection switch means 738, and the copying mode selection switch means 740 are fed to the control means 726. On the basis of the various signals, the control means 726 controls the electromagnetic solenoids 608 and 716, the stepping motors 662 and 682, and the display lamps 752, 754, 760 and 762 in the following manners. The control means 726 in the illustrated embodiment includes a return obstructing means 764 with regard to the fact that a copying paper can be manually loaded onto the paper receiving stand of the paper receiving and delivering means 590.

Figure 12:
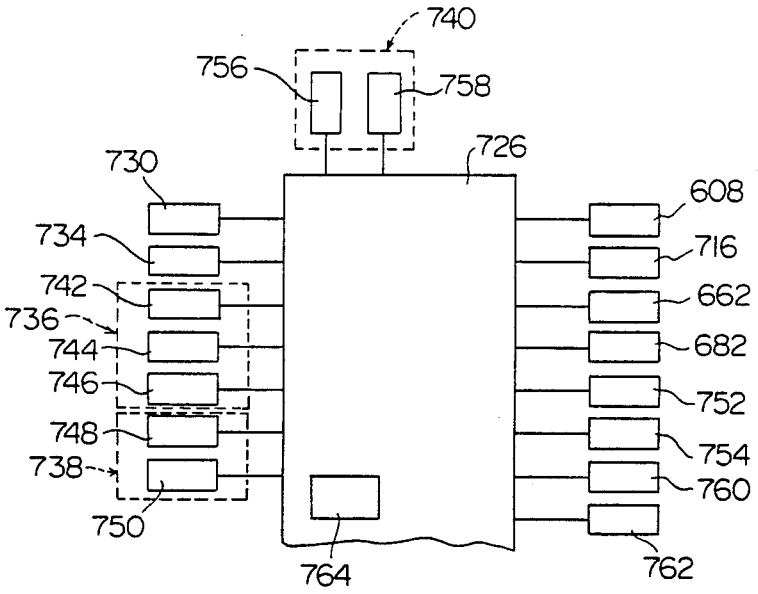
FIG. 12 is a simplified view showing part of a control system in the copying apparatus of FIG. 8.
Figure 13:
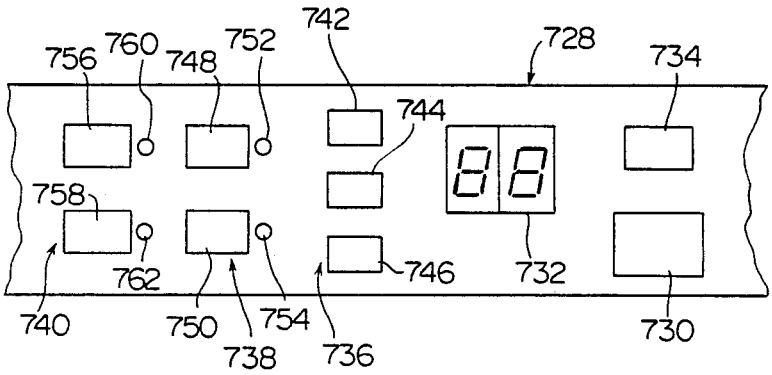
FIG. 13 is a front elevation showing part of an operating panel in the copying apparatus of FIG. 8.

With reference mainly to FIGS. 8, 10 and 12, the operation and advantages of the illustrated copying apparatus, mainly of the paper receiving and delivering means 590 will be described generally.

In the case of one-surface copying, the switch 756 is depressed to select the one-surface copying mode. As a result, based on the signal from the switch 756, the control means 726 sets the copying apparatus in the one-surface copying mode and turns on the lamp 760 to display this mode.

When it is desired to feed copying paper sheets from the paper feed means 548 in the one-surface copying mode, the switch 748 is depressed. As a result, on the basis of the signal from the switch 748, the control means 726 permits the feeding of paper from the paper feed means 548 and displays it by turning on the lamp 752. When the copying start button 730 is then depressed, the copying process of the copying apparatus is started, and a copying paper is delivered to the paper conveying passage 558 from the paper cassette 550 by the action of the delivery roller 554.

When it is desired to feed a copying paper from the paper receiving and delivering means 590 (for example, when it is desired to produce a copy on a copying paper having a different size than the paper received in the paper cassette 550), the switch 750 is depressed. As a result, the control means 726 permits paper feeding from the paper receiving and delivering means 590 and displays it by turning on the lamp 754. Then, the distance between the width restricting members 670*a* and 670*b* in the paper receiving and delivering means 590 is set at a desired value by operating the paper size selection manual switch means 736. Specifically, when it is desired to produce a copy on a copying paper having JIS A4 size (or JIS B4 size or JIS B5 size), the switch 742 (or 744, or 746) is depressed. As a result, on the basis of the signal from the switch 742 (or 744 or 746), the control means 726 actuates and controls the stepping motor 682 properly. When the pinion 686 is rotated in the direction of arrow 690 (or 692) by the stepping motor 682, the pair of width restricting members 670*a* and 670*b* are moved outwardly (or inwardly) in the widthwise direction via the moving members 684*a* and 684*b* and the pin members 676*a* and 676*b* and the distance between the width restricting members becomes larger (or smaller), and consequently, the width restricting members 670*a* and 670*b* are held at a position corresponding to the desired size of a copying paper on which to produce a copy. Then, a copying paper is loaded in place in the paper receiving and delivering means 590 by properly positioning the paper on the paper receiving stand through the upper surface of the rear portion of the frame member 642 which projects from the housing 502. At the time of paper loading, the elevating members 668*a* and 668*b* of the receiving plate elevating means 658 are at the aforesaid inoperative position and the receiving plate 646 is held at the receiving position. At the same time, the distance between the width restricting members 670*a* and 670*b* is set at a predetermined value in the manner described above. Hence, the loading of paper is easy. When the copying start button 730 is then depressed, the copying process is started and at the same time, the receiving plate 646 is elevated properly. Specifically, on the basis of the signal from the copying start button 730, the control means 726 energizes the stepping motor 662 to rotate the supporting shaft 666 substantially through 90 degrees. As a result, the elevating members 668*a* and 668*b* are held at the operating position to elevate the front portion of the receiving plate 646 and press the paper on the receiving plate 646 against the delivery roller 696. When the delivery roller 696 is then rotated, the paper is delivered from the frame member 642 to the paper delivery passage 592 by the action of the delivery roller 696. Paper sheets so delivered then undergo the action of the means 700 to prevent delivery of two or more papers at a time and are delivered one by one toward the paper conveying passage 558. The electromagnetic solenoid 716 of the means 700 is energized by depressing the copying start button 730. The pivoting supporting member 712 is pivoted in the direction of arrow 718 (FIG. 11), and the friction pad 704 is held at the operating position and acts on the roller 702. In this state, the paper is conveyed between the roller 702 and the friction pad 704.

When both-surface copying is desired, the switch 758 is depressed to select the both-surface copying mode. On the basis of the signal from the switch 758, the control means 726 sets the copying apparatus in the both-surface copying mode, and displays it by turning on the lamp 762. Specifically, on the basis of the signal from the switch 758, the control means 726 energizes the electromagnetic solenoid 608. Energization of the electromagnetic solenoid 608 causes the plate members 596 of the conveyance control means 578 to pivot about the supporting shaft 598 as a center and be held at the second position, thereby permiting returning of paper through the paper returning passage 588.

Thereafter, the switch 748 is depressed in the same way, whereupon as described above the control means 726 permits feeding of paper from the paper feed means 548 and displays it by turning on the lamp 752. When at this time, switch 750 instead of the switch 748 is depressed, the control means 726 permits feeding of paper from the paper receiving and delivering means 590 and displays it by turning on the lamp 754. But at the same time, the return obstructing means 764 of the control means 726 produces a return obstructing signal, on the basis of which the electromagnetic solenoid 608 is deenergized and the lamp 762 is turned off. Deenergization of the electromagnetic solenoid 608 causes the plate members 596 of the conveyance control means 578 to return to the first position and thereby to accurately obstruct returning of paper through the paper returning passage 558.

When the copying start button 730 is then depressed, the copying process of the copying apparatus is started. When the switch 748 has previously been depressed (to permit paper feeding from the paper feed means 548), a copying paper is fed to the paper conveying passage 558 from the paper cassette 550 by the action of the delivery roller 554, guided by the plate members 596 of the conveyance control means 578 from the paper conveying passage 558, and introduced into the paper returning passage 588. On the other hand, when the switch 750 has previously been depressed (to permit paper feeding from the paper receiving and delivering means 590), a copying paper is fed to the paper conveying passage 558 from the frame member 642 by the action of the delivery roller 696 (only where paper exists on the paper receiving plate), and discharged out of the housing 502 through the paper conveying passage 558 and the paper discharge passage 584.

The copying paper which has been introduced into the paper returning passage 588 after being fed from the paper feed means 548 passes through the paper returning passage 588 and is received by the paper receiving and delivering means 590. At the time of paper receiving, the elevating members 668*a* and 668*b* of the receiving plate elevating means 658 are at the inoperative position and the receiving plate 646 is held at the receiving position. Hence, the paper passes through the recess 720 formed in the front wall 694 of the frame member 642 and is received on the paper receiving stand.

When the paper has thus been received, the control means 726 then actuates and controls the stepping motor 682 to reciprocate the width restricting members 670*a* and 670*b* in the widthwise direction. Specifically, the pinion 686 is rotated in the direction of arrow 692 (FIG. 10) by the stepping motor 682 to move the width restricting members 670*a* and 670*b* inwardly in the widthwise direction and adjust the widthwise positions of the copying paper sheets on the paper receiving stand. Then, the pinion 686 is rotated in the direction of arrow 690 (FIG. 10) to move the width restricting members 670*a* and 670*b* outwardly in the widthwise direction. When the paper is properly received, the control means 726 deenergizes the electromagnetic solenoid 608. Consequently, the plate members 596 of the conveyance control means 578 are held at the first position.

Then, the copying start button 730 is again depressed in order to produce a copy on the other surface of the paper, the copying process is resumed and the receiving plate 646 of the paper receiving and delivering means 590 is elevated. Specifically, on the basis of the signal from the copying start button 730, the control means 726 energizes the stepping motor 662 to rotate the supporting shaft 666 substantially through 90 degrees. As a result, in the same way as stated above, the elevating members 668*a* and 668*b* are held at the operating position to elevate the front portion of the receiving plate 646 and press the paper on the receiving plate 646 against the delivery roller 696. When the delivery roller 696 is then rotated, the copying paper is delivered to the paper delivering passage 592 from the frame member 642 by the action of the delivery roller 696. As can be understood from FIG. 8, the copying paper is delivered at this time to the delivering passage 592 in a direction opposite to the direction of paper returning through the paper returning passage 558 with its image-bearing surface directed downwardly. Paper sheets so delivered undergo the action of the means 700 to prevent delivery of two or more paper sheets at a time, and fed one by one toward the paper conveying passage 558 (the electromagnetic solenoid 716 of the means 700 is energized by depressing the copying start button 730 for producing a copy on the other surface of the paper sheets).

The copying apparatus described above is constructed such that the conveyance control means 578 is not held at the second position in the case of feeding a copying paper from the paper receiving and delivering means 590. If desired, it is also possible to consturct it such that when copying paper sheets exist in the paper receiving and delivering means 590 at the time of feeding a copying paper from the paper feed means 548, the conveyance control means 578 is likewise not held at the second position.

In the copying apparatus of the second embodiment described above, the paper receiving and delivering means 590 not only acts to receive paper returned through the paper returning passage 588 and deliver it to the paper conveying passage 558, but also permits loading of paper thereon from outside the housing 502 and also acts to deliver the paper so loaded to the paper conveying passage 558. Accordingly, the paper receiving and delivering means 590 can be effectively utilized to feed new copying paper to the paper conveying passage 558, and therefore serves to increase the efficiency of copying in the formation of an image only on one surface of paper without increasing the number of the paper feed means.

What is claimed is:

1. In a copying apparatus comprising a housing, a photosensitive member disposed within the housing, an image-forming means for forming an image on the photosensitive member, a copying paper conveying passage defined within the housing and extending through a transfer zone where the image formed on the photosensitive member is transferred to a copying paper sheet, a copying paper feed means for feeding a copying paper sheet to the upstream end of the paper conveying passage, a copying paper returning passage defined within the housing, a conveyance control means adapted to be selectively held at a first position for discharging the paper sheet conveyed through the paper conveying passage out of the housing and a second position for conducting the paper sheet to the paper returning passage, and a copying paper receiving and delivering means capable of receiving the paper sheet returned through the paper returning passage and delivering it to the upstream end of the paper conveying passage, the improvement of means for enabling said copying paper receiving and delivery means to be employed, when said copying apparatus is in a mode of operation for forming an image on only one surface of a copying paper sheet and said conveyance control means is maintained in said first position thereof blocking passage of the paper sheets to said paper returning passage, as an alternative source of copying paper sheets, separate from said copying paper feed means, for feeding copying paper sheets to said upstream end of said paper conveying passage, said enabling means including a construction of said copying paper receiving and delivering means comprising:

a paper receiving stand supporting means positioned within said housing;

a copying paper receiving stand constructed to be manually loaded with copying paper sheets and to be selectively manually detachable insertable into and removable from said supporting means at a position with respect thereto to enable delivery to said upstream end of said paper conveying passage of the manually loaded copy paper sheets; and said copying paper receiving stand further having means for, when said copying paper receiving stand is in said position and when said copying apparatus is in a mode of operation for forming images on both surfaces of a copying paper sheet fed from said copying paper feed means, receiving paper sheets returned through said paper returning passage such that the thus received paper sheets may be delivered therefrom to said upstream end of said paper conveying passage.

2. The improvement of claim 1, wherein an opening for the paper receiving stand is formed in one side wall of the housing, and the paper receiving stand is mounted on said receiving stand supporting means by inserting it through the opening, and is detached from the supporting means by withdrawing it through the opening.

3. The improvement of claim 1 wherein the paper receiving stand comprises a frame member having a front wall against which the leading edge of the copying paper returned through the paper returning passage abuts and a receiving plate mounted on the frame member so that is can be freely elevated from a copying paper receiving position;

the copying paper receiving and delivering means further comprises a delivery roller disposed within the housing and adapted to be selectively rotated, and a receiving plate elevating means for elevating the receiving plate selectively; and whereby when the paper on the paper receiving stand is delivered to the upstream end of the paper conveying passage, the receiving plate is elevated from the paper receiving position by the action of the receiving plate elevating means, the paper on the receiving plate is pressed by the delivery roller, and the paper on the receiving plate is delivered toward the upstream end of the paper conveying passage by the rotation of the delivery roller.

4. The improvement of claim 3, wherein the receiving plate elevating means is mounted within the housing.

5. The improvement of claim 3, wherein at least one width restricting member is mounted on the paper receiving stand in such a manner that its widthwise position can be freely adjusted.

6. The improvement of claim 5, wherein a pair of width restricting members are mounted on the paper receiving stand in such a manner that their widthwise positions can be freely adjusted.

7. The improvement of claim 5 wherein a paper trailing edge restricting member is mounted on the paper receiving stand in such a manner that its distance from the front wall is adjustable.

8. The improvement of claim 1, wherein a copying paper cassette including a plurality of copying paper sheets is detachably mounted on the supporting means instead of the paper receiving stand so that the copying paper sheets in the cassette can be delivered toward the upstream end of the paper conveying passage from the paper receiving and delivering means.

9. The improvement of claim 8, wherein the copying paper cassette includes a frame member and a receiving plate mounted on the frame member for free elevation from a paper receiving position.

10. The improvement of claim 1, wherein:

the copying paper feed means comprises a copying paper cassette supporting means formed within the housing, a copying paper cassette adapted to be mounted detachably on the cassette supporting means, and a paper feed roller disposed within the housing and adapted to be selectively rotated for delivering paper sheets received in the paper cassette mounted on the cassette supporting means toward the upstream end of the paper conveying passage; and said paper receiving stand has a construction such that a plurality of copying paper sheets can be manually loaded in said paper receiving stand when detached from the supporting means, and then the paper receiving stand can be detachably mounted in said cassette supporting means in place of the paper cassette, whereby the copying paper sheets loaded manually in said paper receiving stand are delivered toward the upstream end of the paper conveying passage by the rotation of the paper feed roller.

11. The improvement of claim 1 further comprising a copying paper reversing passage defined within the housing, and in which when the conveyance control means is held at the second position thereof, the paper conveyed through the paper conveying passage is introduced into the paper reversing passage, and then by the reversing of its moving direction, is introduced into the paper returning passage from the paper reversing passage.

12. In a copying apparatus comprising a housing, a photosensitive member disposed within the housing, an image-forming means for forming an image on the photosensitive member, a copying paper conveying passage defined within the housing and extending through a transfer zone where the image formed on the photosensitive member is transferred to a copying paper, a copying paper feed means for feeding a copying paper sheet to the upstream end of the paper conveying passage, a copying paper returning passage defined within the housing, a conveyance control means adapted to be selectively held at a first position for discharging the paper sheet conveyed through the paper conveying passage out of the housing and a second position for conducting said paper sheet to the paper returning passage, and a copying paper receiving and delivering means disposed adjacent to the downstream end of the paper returning passage and being capable of receiving the paper sheet returned through the paper returning passage and delivering the paper sheet to the upstream end of the paper conveying passage in a direction opposite to the direction of the paper returned through the returning passage the improvement of means for enabling said copying paper receiving and deliver means to be employed, when said copying apparatus is in a mode of operation for forming an image on only one surface of a copying paper sheet and said conveyance control means is maintained in said first position thereof blocking passage of the paper sheets to said paper returning passage, as an alternative source of copying paper sheets, separate from said copying paper feed means, for feeding copying paper sheets to said upstream end of said paper conveying passage, said enabling means including a construction of said copying paper receiving and delivering means comprising:

a copying paper receiving stand constructed to be selectively manually detachably insertable into and removable from said housing at a position to at least partially project outwardly therefrom and to enable, when in said position, copying paper sheets to be manually loaded into said paper receiving stand from the exterior of said housing and to be delivered therefrom to said upstream end of said paper conveying passage; and said copying paper receiving stand further having means for, when said copying paper receiving stand is in said position and when said copying apparatus is in a mode of operation for forming images on both surfaces of a copying paper sheet fed from said copying paper feed means, receiving paper sheets returned through said paper returning passage such that the thus received paper sheets may be delivered therefrom to said upstream end of said paper conveying passage.

13. The improvement of claim 12, wherein:

the paper receiving and delivering means further includes a copying paper delivery roller rotatably mounted above the paper receiving stand and being adapted to be selectively rotated;

the paper receiving stand includes a frame member detachably mounted on the housing and a receiving plate mounted on the frame member in such a manner that it is free to rise from a receiving position below the paper delivery roller; and the paper receiving and delivering means further includes a receiving plate elevating means for selectively elevating the receiving plate and pressing the paper sheets on the receiving plate against the delivery roller.

14. The improvement of claim 13, wherein the receiving plate elevating means is mounted on the frame member.

15. The improvement of claim 14, wherein the receiving plate elevating means comprises an elevating member mounted for free movement between an inoperative position at which the receiving plate is at the receiving position thereof and an operating position at which it elevates the receiving plate, and an elevating member positioning means for selectively holding the elevating member at the inoperative position thereof or the operating position thereof.

16. The improvement of claim 13, wherein at least one width restricting member is mounted on the upper surface of the receiving plate for free movement in the widthwise direction.

17. The improvement of claim 16, wherein a pair of width restricting members are mounted on the upper surface of the receiving plate for free movement in the widthwise direction.

18. The improvement of claim 16, wherein the copying paper receiving stand has mounted thereon moving means for moving the width restricting member in the widthwise direction.

19. The improvement of claim 18, wherein the moving means is mounted on the under surface of the receiving plate.

20. The improvement of claim 18, which further comprises a manual switch means for paper size selection and a control means for actuating the moving means according to the manual operation of the manual switch means.

21. The improvement of claim 12, wherein a copying paper delivering passage extending from the paper receiving and delivering means to the upstream end of the paper conveying passage is disposed within the housing, and means for preventing delivery of two or more copying paper sheets at a time is provided in the paper delivering passage.

22. The improvement of claim 21, wherein the means for preventing delivery of two or more paper sheets at a time comprises a rotatably mounted rotating shaft, a roller mounted on the rotating shaft, a friction pad formed of a material having a high coefficient of friction, said pad being mounted so as to move freely between an operating position at which it is pressed toward the roller and an inoperative position at which it is spaced from the roller, and a friction pad positioning means for holding the friction pad selectively at the operation position thereof or the inoperative position thereof.

23. The improvement of claim 22, wherein the paper returning passage extends below the paper conveying passage and the paper delivering passage, and a plurality of return rollers which act on the upper surface of the copying paper in the downstream end portion of the paper returning passage is mounted in spaced-apart relationship in the widthwise direction on the rotating shaft of the means for preventing delivery of two or more paper sheets at a time.

24. The improvement of claim 23, wherein the housing includes a bottom wall made of a synthetic resin, a plurality of protrusions defining the underside of at least a part of the paper returning passage are formed integrally with the upper surface of the bottom wall in spaced-apart relationship in the widthwise direction, each of the return rollers is arranged to align with a respective one of the protrusions, and the copying paper sheet is returned by the cooperative action of the return rollers and the protrusions.

25. The improvement of claim 12, wherein the conveyance control means includes a plurality of plate members disposed in spaced-apart relationship in the widthwise direction, when the plate members are held at the first position thereof the paper conveyed through the paper conveying passage is discharged out of the housing by being guided by upper edges of the plate members, and when the plate members are held at the second position, thereof the paper conveyed through the paper conveying passage is conducted to the paper returning passage by being guided by front edges of the plate members.

26. The improvement of claim 25, wherein a rotating shaft mounted rotatably above the plate members and a plurality of discharge rollers mounted on the rotating shaft in spaced-apart relationship in the widthwise direction in alignment with the plate members are provided within the housing, and when the plate members are held at the first position thereof the paper conveyed through the paper conveying passage is discharged out of the housing by the cooperative action of the discharge rollers and the upper edges of the plate members.

27. The improvement of claim 12, which further comprises:

a manual selection switch means selectively permitting the feeding of paper to the paper conveying passage by the paper feed means and the delivery of paper to the paper conveying passage by the paper receiving and delivering means; and a return obstructing means which permits the conveyance control means to be selectively held at the first position thereof or the second position thereof when the feeding of paper to the paper conveying passage by the paper feed means is permitted, but which obstructs the positioning of the conveyance control means at the second position thereof when the delivery of paper to the paper conveying passage by the receiving and delivering means is permitted.

28. In a copying apparatus comprising a housing, a photosensitive member disposed within the housing, an image-forming means for forming an image on the photosensitive member, a copying paper conveying passage defined within the housing and extending through a transfer zone where the image formed on the photosensitive material is transferred to a copying paper sheet, a copying paper returning passage defined within the housing, a conveyance control means for selectively holding the paper conveyed through the paper conveying passage at a first position for discharging it outside the housing and a second position for conducting it to the paper returning passage, and a copying paper receiving and delivering means disposed adjacent to the downstream end of the paper returning passage and being capable of receiving the paper returned through the paper returning passage and delivering it to the upstream end of the paper conveying passage through the paper delivering passage, the improvement comprising:

means, provided in said paper delivery passage, for preventing delivery of two or more copying paper sheets at a time, said preventing means comprising a rotatably mounted rotating shaft, a roller mounted on the rotating shaft, a friction pad formed of a material having a high coefficient of friction and mounted movably between an operating position at which it is pressed toward the roller and an inoperative position at which it is spaced from the roller, and a friction pad positioning means for selectively moving the friction pad between the operating position thereof and the inoperative position thereof;

the paper returning passage extending below the paper conveying passage and the paper delivering passage;

a plurality of return rollers acting on the upper surface of the copying paper in the downstream end portion of the paper returning passage and mounted in spaced-apart relationship in the widthwise direction on the rotating shaft of the means for preventing delivery of two or more copying paper sheets at a time; and the housing including a bottom wall of a synthetic resin, a plurality of protrusions defining at least a part of the paper return passage and formed integrally on the upper surface of the bottom wall in spaced-apart relationship, each of the return rollers being arranged to align with a respective one of the protrusions, and by the cooperative action of the returning rollers and the protrusions, the paper is returned through the paper returning passage.

29. In a copying apparatus comprising a housing, a photosensitive member disposed within the housing, an image-forming means for forming an image on the photosensitive member, a copying paper conveying passage defined within the housing and extending through a transfer zone where the image formed on the photosensitive member is transferred to a copying paper sheet, a copying paper returning passage defined within the housing, a conveyance control means adapted to be selectively held at a first position for discharging the paper sheet conveyed through the paper conveying passage out of the housing and a second position for conducting said paper sheet to the paper returning passage, and a copying paper receiving and delivering means disposed adjacent to the downstream end of the paper returning passage and being capable of receiving the paper sheet returned through the paper returning passage and delivering the paper sheet to the upstream end of the paper conveying passage in a direction opposite to the direction of the paper returned through the returning passage, the improvement wherein:

the paper receiving and delivering means includes a copying paper receiving stand mounted detachably on the housing and at least partly projecting out of the housing, such that the paper returned through the paper returning passage is received on the paper receiving stand and a copying paper sheet can be manually loaded in the copying paper receiving stand from outside the housing;

a copying paper delivering passage is disposed within the housing and extends from the paper receiving and delivering means to the upstream end of the paper conveying passage;

means for preventing delivery of two or more paper sheets at a time includes a rotatably mounted rotating shaft, a roller mounted on the rotating shaft, a friction pad formed of a material having a high coefficient of friction, said pad being mounted so as to move freely between an operating position at which it is pressed toward the roller and an inoperative position at which it is spaced from the roller, and a friction pad positioning means for holding the friction pad selectively at the operating position thereof or at the inoperative position thereof;

said paper returning passage extends below the paper conveying passage and the paper delivering passage;

a plurality of return rollers act on the upper surface of the copying paper in the downstream end portion of the paper returning passage and are mounted in spaced-apart relationship in the widthwise direction on the rotating shaft of said means for preventing delivery of two or more paper sheets at a time; and said housing includes a bottom wall made of a synthetic resin, a plurality of protrusions define the underside of at least a part of the paper returning passage and are formed integrally with the upper surface of the bottom wall in spaced-apart relationship in the widthwise direction, each of the return rollers is arranged in alignment with a respective one of the protrusions, and the copying paper sheet is returned by the cooperative action of the return rollers and the protrusions.

30. In a copying apparartus comprising a housing, a photosensitive member disposed within the housing, an image-forming means for forming an image on the photosensitive member, a copying paper conveying passage defined within the housing and extending through a transfer zone where the image formed on the photosensitive member is transferred to a copying paper sheet, a copying paper returning passage defined within the housing, a conveyance control means adapted to be selectively held at a first position for discharging the paper sheet conveyed through the paper conveying passage out of the housing and a second position for conducting said paper sheet to the paper returning passage, and a copying paper receiving and delivering means disposed adjacent to the downstream end of the paper returning passage and being capable of receiving the paper sheet returned through the paper returning passage and delivering the paper sheet to the upstream end of the paper conveying passage in a direction opposite to the direction of the paper returned through the returning passage, the improvement comprising:

the paper receiving and delivering means including a copying paper receiving stand mounted detachably on the housing and at least partly projecting out of the housing, such that the paper returned through the paper returning passage is received on the paper receiving stand and a copying paper sheet can be manually loaded in the copying paper receiving stand from outside the housing;

said conveyance control means including a plurality of plate members disposed in spaced-apart relationship in the widthwise direction, whereby when the plate members are held at the first position thereof the paper sheets conveyed through the paper conveying passage are discharged out of the housing by being guided by upper edges of the plate members, and when the plate members are held at the second position thereof the paper sheets conveyed through the paper conveying passage are conducted to the paper returning passage by being guided by front edges of the plate members;

a rotating shaft mounted rotatably above the plate members and a plurality of discharge rollers mounted on the rotating shaft in spaced-apart relationship in the widthwise direction in alignment with the plate members provided within the housing, such that when the plate members are held at the first position thereof the paper conveyed through the paper conveying passage is discharged out of the housing by the cooperative action of the discharge rollers and the upper edges of the plate members;

copying paper feed means for feeding copying paper sheets to the upstream end of the paper conveying passage;

manual selection switch means selectively permitting the feeding of paper sheets to the paper conveying passage by the paper feed means and the delivery of paper to the paper conveying passage by the paper receiving and delivering means; and return obstructing means for permitting the conveyance control means to be selectively held at the first position thereof or the second position thereof when the feeding of paper sheets to the paper conveying passage by the paper feed means is permitted, but for obstructing the positioning of the conveyance control means at the second position thereof when the delivery of paper sheets to the paper conveying passage by the receiving and delivering means is permitted.

* * * * *